US011364415B2

(12) United States Patent
Sullivan

(10) Patent No.: US 11,364,415 B2
(45) Date of Patent: Jun. 21, 2022

(54) OVERHEAD BAR MOUNT EXERCISE TRAINING DEVICE

(71) Applicant: Thomas C. Sullivan, Grand Rapids, MI (US)

(72) Inventor: Thomas C. Sullivan, Grand Rapids, MI (US)

( * ) Notice: Subject to any disclaimer, the term of this patent is extended or adjusted under 35 U.S.C. 154(b) by 0 days.

(21) Appl. No.: 16/987,074

(22) Filed: Aug. 6, 2020

(65) Prior Publication Data

US 2020/0360763 A1 Nov. 19, 2020

Related U.S. Application Data

(63) Continuation-in-part of application No. 16/573,141, filed on Sep. 17, 2019.

(60) Provisional application No. 62/806,029, filed on Feb. 15, 2019.

(51) Int. Cl.

| | |
|---|---|
| ***A63B 23/02*** | (2006.01) |
| ***A63B 1/00*** | (2006.01) |
| ***A63B 71/06*** | (2006.01) |

(52) U.S. Cl.

CPC ..... *A63B 23/0216* (2013.01); *A63B 1/00* (2013.01); *A63B 71/06* (2013.01); *A63B 2071/0602* (2013.01); *A63B 2208/029* (2013.01)

(58) Field of Classification Search

CPC .... A63B 2069/0042; A63B 21/16–169; A63B 23/0211; A61H 3/008

See application file for complete search history.

(56) References Cited

U.S. PATENT DOCUMENTS

| | | | | |
|---|---|---|---|---|
| 3,612,042 | A | 10/1971 | Fry | |
| 3,716,232 | A | 2/1973 | Johnson et al. | |
| 4,428,578 | A * | 1/1984 | Kirkpatrick | A63B 21/04 482/129 |
| 4,468,022 | A * | 8/1984 | Wu | A63B 23/0211 482/140 |
| 4,611,805 | A * | 9/1986 | Franklin | A63B 21/04 482/129 |
| 4,679,788 | A * | 7/1987 | Adler | A63B 21/0615 482/108 |
| 5,458,551 | A * | 10/1995 | Shenton | A63B 69/004 482/83 |
| 5,997,448 | A | 12/1999 | Duba | |
| 9,272,198 | B2 * | 3/2016 | Brenner | A63B 69/004 |
| 9,452,308 | B2 | 9/2016 | Lentz et al. | |
| 9,687,692 | B1 | 6/2017 | Adelman | |

(Continued)

*Primary Examiner* — Nyca T Nguyen
(74) *Attorney, Agent, or Firm* — Cook Alex Ltd.

(57) ABSTRACT

An exercise training device for connection to a laterally extending overhead bar and use in modifying a toes to bar exercise, including at least one bar mounting assembly, an elongated, laterally extending target portion, and a spacer portion connected at a first end to and extending longitudinally away from the at least one bar mounting assembly, and removably connected at an opposed second end to the elongated, laterally extending target portion. Also disclosed is a method of positioning an exercise training device on a laterally extending overhead bar to modify a toes to bar exercise, including connecting to the laterally extending overhead bar an exercise training device having the aforementioned structure, and adjusting the exercise training device to extend downward and forward from the laterally extending overhead bar.

19 Claims, 14 Drawing Sheets

(56) References Cited

U.S. PATENT DOCUMENTS

| | | | | |
|---|---|---|---|---|
| 9,868,006 | B1 | 1/2018 | Epler | |
| 9,908,003 | B1 * | 3/2018 | Chin | A63B 21/4039 |
| 2003/0132614 | A1 * | 7/2003 | Kreamer | A63B 69/0028 280/655.1 |
| 2011/0162173 | A1 * | 7/2011 | Ciminski | F16B 2/10 16/421 |
| 2013/0244836 | A1 | 9/2013 | Maughan | |
| 2013/0310232 | A1 * | 11/2013 | Flores | A63B 21/16 482/131 |
| 2014/0243173 | A1 * | 8/2014 | Thompson | A63B 21/4015 482/139 |
| 2015/0080187 | A1 * | 3/2015 | Beane | A63B 69/0064 482/51 |
| 2016/0324717 | A1 * | 11/2016 | Burton | A61H 7/001 |
| 2017/0354838 | A1 * | 12/2017 | Fitzpatrick | A63B 1/00 |
| 2020/0261758 | A1 | 8/2020 | Souffain | |

* cited by examiner 124a
112
124
118
126
116
116a
116f
116i
116c
116b
116e
116d
120
114
110

124b
116g
116h 424c
424a
424
412
418
416a
416
416c
426
428a
428
416b
420
414b
410

414e
414d
414f
414c
414a
422

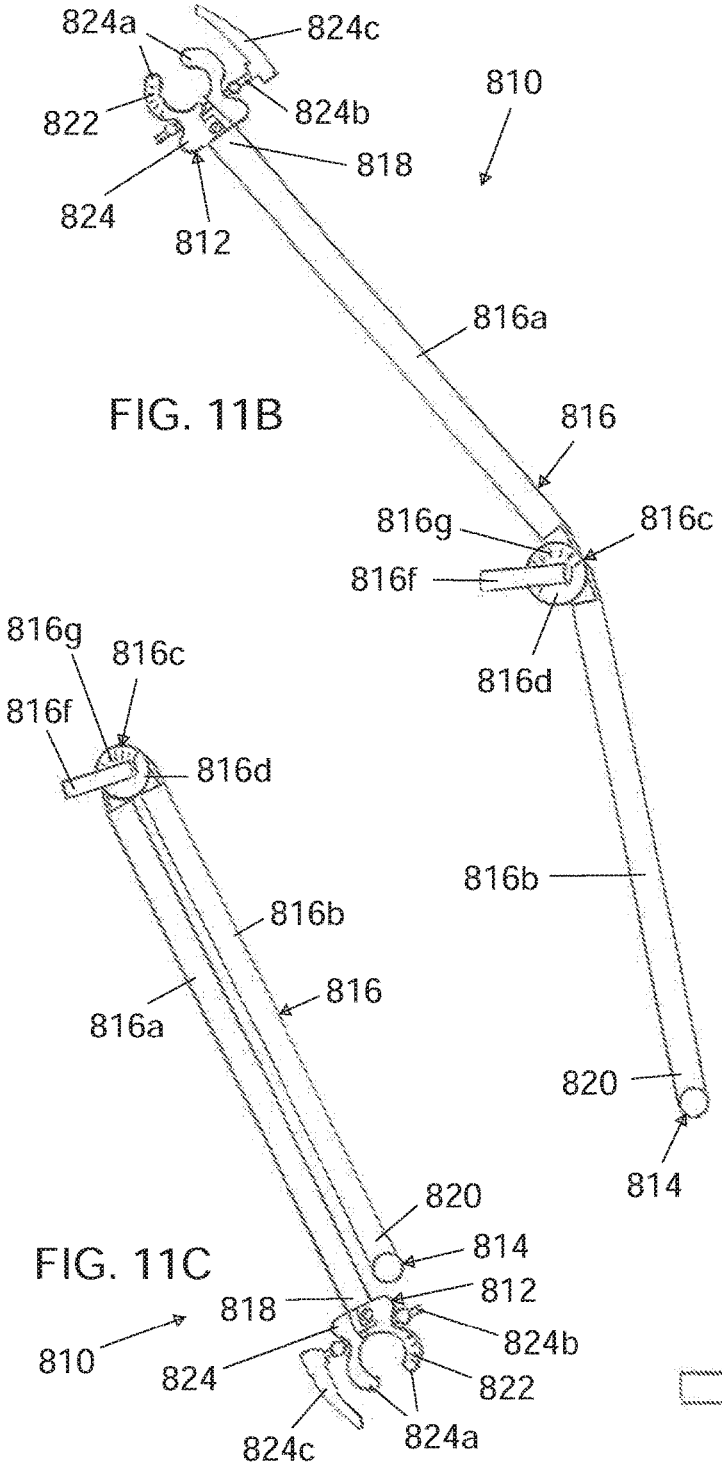
FIG. 11B
FIG. 11C
FIG. 11A
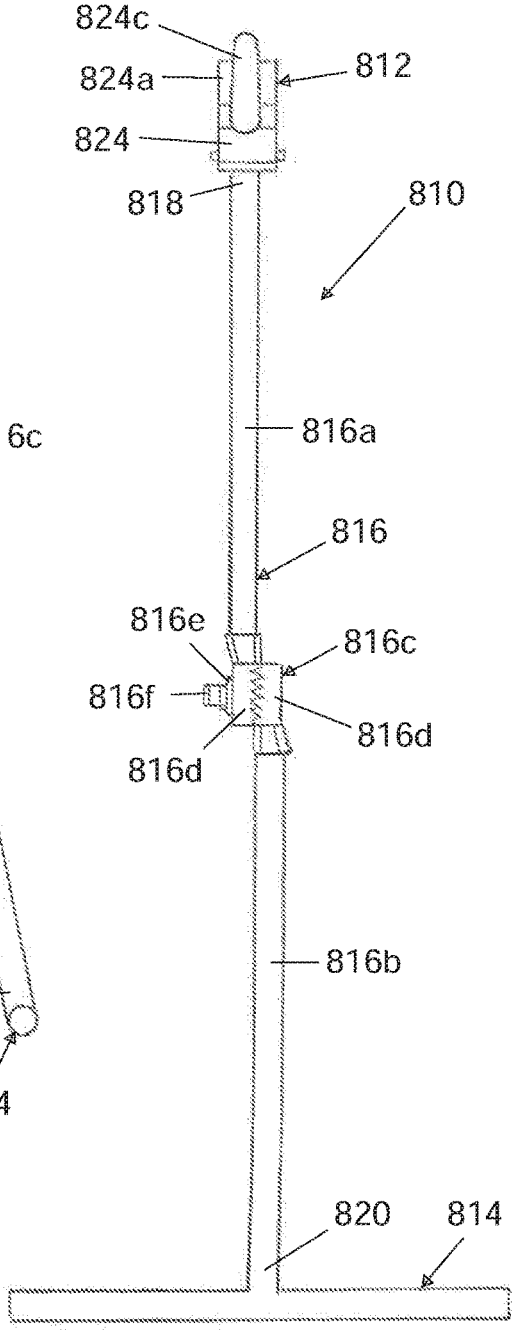

OVERHEAD BAR MOUNT EXERCISE TRAINING DEVICE

CROSS-REFERENCE TO RELATED APPLICATIONS

This application is a continuation-in-part of U.S. patent application Ser. No. 16/573,141, filed Sep. 17, 2019, and claims priority of U.S. Provisional Patent Application Ser. No. 62/806,029, filed Feb. 15, 2019, both of which applications are hereby incorporated by reference in their entirety for all purposes.

FIELD OF THE DISCLOSURE

The present disclosure is directed to exercise training equipment, and more particularly to an exercise training device and method of training to assist a user in developing the ability to complete an exercise commonly referred to as "toes to bar."

BACKGROUND

Many individuals participate in exercises of various types. Within the fitness industry, certain exercises are utilized to target specific areas of the body. An exercise known as "toes to bar" is performed by an individual when hanging from a bar, and often is used to train upper body and core strength. The exercise is performed on a bar that extends laterally (side-to-side) relative to the individual. However, the bar is located sufficiently above the individual to be able to hang from the bar, so it also may be referred to as an overhead bar.

To perform the exercise, the individual first elevates, such as by jumping, and grasps the bar with the individual's hands. The exercise movement begins from an extended hanging position, with the individual hanging downward from the bar by the hands, with the individual's feet closet to the ground. The exercise can be performed using a slow and controlled (strict) motion or using a swinging (kipping) motion.

When using either motion, the individual engages the core muscles to bend at the hips and to raise the individual's feet until they contact the bar from which the individual is hanging. Thus, this can be done using a strict motion or a kipping motion. The toes to bar exercise is considered to be an excellent exercise for training strength in the hand gripping muscles, upper body and back muscles, as well as the core and abdominal muscles. It also is used in high intensity workouts to maintain a high heart rate, while completing numerous repetitions at a time or by periodically performing repetitions throughout a workout.

However, due to its difficulty, most individuals are not able to initially perform the toes to bar exercise. Indeed, trainers often have to try to modify, scale, or adjust the difficulty of the toes to bar exercise, such as by starting with exercises to be performed while the individual is on the ground. The modifications may involve core strength building exercises, bending or the like, but generally are not very effective with respect to translating to an ability to perform the exercise. Once the individual attempts the exercise while hanging from a bar, the individual either successfully completes the movement as prescribed, or unfortunately ends up moving the feet and body in ways that are not consistent or repeatable, and with a lack of any way to measure progress. This can be very frustrating and has prevented a meaningful and measurable way to modify, scale or adjust the toes to bar exercise.

SUMMARY

The present disclosure includes examples of exercise training devices that advantageously may be used in training to progress to a point of being able to successfully complete the toes to bar exercise. The example devices offer a way for a trainer working with an individual, or for an individual independently, to modify, scale, and adjust the toes to bar exercise while actually working on a bar. The devices are configured such that they may be suitable for use by individuals having a skill level ranging from beginner to expert. This is possible because the devices may be used to present a range of target positions for the feet to contact while practicing and increasing the ability to perform the movement. To modify or scale the exercise, depending on the individual's initial ability and progress during training, the target may be adjusted to various positions lower than the bar, as well as to various positions forward of the bar. Indeed, the target may even be positioned above the bar to provide a more difficult challenge than the standard bar, if desired. When not in use, the target may be conveniently moved to a position above the bar and out of the way of other exercises, such as pull-ups or chin-ups, or may be removed from the bar entirely.

The example exercise training devices provide a further advantage by allowing for measurable and repeatable results, by which an individual can establish improvement in the toes to bar exercise. With continued practice or training, an individual may be able to progress to finally complete the movement without the device, so as to contact the bar directly with the individual's feet. Also, the example devices allow an individual to increase the workout intensity and muscle development, by permitting the individual to work on an overhead bar and attempt an exercise that demands use of gripping muscles, along with the upper body and core muscles needed to eventually complete the toes to bar movement. It has not been possible to efficiently scale the exercise using previously known methods involving bar or floor work, because such efforts have not been able to appropriately target the muscles needed to progress to perform the toes to bar exercise. It will be appreciated that the example devices permit the bar to be suspended above the individual by any suitable structure and may be a continuous bar or may have two spaced apart portions for gripping that are connected to a further bar. The bar may be suspended overhead such as by being mounted to a rack having support members that rest on the ground, mounted to a wall having supports extending outward from the wall to the bar, whether the bar is mounted individually or as part of a stall bars assembly, or mounted to a ceiling or other structure above the bar, such as a ceiling or multi-use gym frame, or the like.

Unlike the overhead bar itself, the example devices are not intended to support the weight of a user. Indeed, a user should not attempt to hang from the device because it merely provides a target for contact by the user's feet. Thus, the devices advantageously may be of relatively light weight, cost effective construction.

It will be appreciated that the example devices may be constructed in various configurations. For instance, the devices generally may have a T-shape or Y-shape configuration having at least one centrally located bar mounting assembly for connection to the bar, a spacer portion connected at a first end to and extending longitudinally away from the at least one bar mounting assembly, and connected at an opposed second end to an elongated, laterally extending target portion. Alternatively, the example devices generally may have a U-shape configuration having two spaced apart bar mounting assemblies for connection to the bar, a spacer portion connected at a first end to and extending longitudinally away from each of the bar mounting assemblies, and an elongated, laterally extending target portion located generally between the two mounting assemblies.

The example devices may provide various alternative advantageous features. For instance, the example devices may be configured to be one-size-fits-all, by being adjustable to accommodate users of different sizes. This may include adjustability with respect to the distance from the target to the bar by virtue of the ability to adjust the length of the longitudinally extending spacer portion and/or target portion. This also may include adjustability with respect to the distance forward of the bar. It will be appreciated that this may be related to the angle at which the spacer portion extends forward from the bar, as well as the adjustable length of the spacer portion and/or longitudinally extending length of the target portion.

In addition, the length of the elongated, laterally extending target portion (width) may be of fixed or adjustable length to accommodate users of different sizes and/or to permit more compact stowage or initial packaging. The target portion also may be constructed using a substantially rigid element to be contacted by the individual's feet, or may utilize a flexible element that is less likely to transmit forces to the spacer portion and the at least one bar mounting assembly when contacted by the individual's feet. In fact, alternative flexible elements may include a generally inelastic element, such as a string, rope, wire or the like, or a resilient element, such as a straight or loop shaped elastic cord, band or the like.

Additional advantageous features may be provided by the at least one bar mounting assembly. For example, the at least one bar mounting assembly that connects the device to the overhead bar may be constructed by use of a variety of different types of clamps, such as a spring clamp or a clamp having a rotatable fastener or the like, to adjust the gripping force applied to the bar. The at least one bar mounting assembly also may be of various configurations, for example, to permit quick and convenient removal of the entire device from the bar when not in use, and/or to readily permit adjustment of the clamping or gripping force so as to release and reposition the at least one bar mounting assembly on the bar when the device is not in use. Still further, the at least one bar mounting assembly may be configured to remain connected to the bar in the same position at all times, while having the convenience of quickly moving the spacer portion and target portion from a stowed position to a position for use. This may be accomplished by having a portion of the device be movably adjustable, such as by pivoting the spacer portion or by having the spacer portion be configured as an elongated flexible, self-supporting member that is able to be moved into various configurations. In a further alternative, some examples may permit the at least one mounting assembly to remain connected to the bar, while removing target portion and/or at least a portion of the spacer portion.

Another convenient feature may include the ability to quickly disassemble or adjust the exercise training device to more compactly stow or ship the device. The example devices also may be constructed using a variety of materials that complement the various configurations, which permit numerous price points for a finished product.

In a first aspect, the present disclosure provides an exercise training device including at least one bar mounting assembly, an elongated, laterally extending target portion, a spacer portion connected at a first end to and extending longitudinally away from the at least one bar mounting assembly, and connected at an opposed second end to the elongated, laterally extending target portion.

In another aspect, the present disclosure provides a method of positioning an exercise training device on a laterally extending overhead bar to modify a toes to bar exercise, including connecting to the laterally extending overhead bar an exercise training device having at least one bar mounting assembly, an elongated, laterally extending target portion, and a spacer portion connected at a first end to and extending longitudinally away from the at least one bar mounting assembly, and the spacer portion connected at an opposed second end to the elongated, laterally extending target portion. The method further includes adjusting the exercise training device to extend downward and forward from the laterally extending overhead bar.

In a further aspect, the present disclosure provides an exercise training device for connection to a laterally extending overhead bar and use in modifying a toes to bar exercise, including at least one bar mounting assembly, an elongated, laterally extending target portion, and a spacer portion connected at a first end to and extending longitudinally away from the at least one bar mounting assembly, and removably connected at an opposed second end to the elongated, laterally extending target portion.

Exercise training devices consistent with the present disclosure provide convenient, compact, easy to use devices that can be conveniently stowed or located in a position for use on an overhead bar. The example exercise training devices may be used by trainers working with group classes where some or all of the individual participants may be using the exercise training devices. The devices also may be used by trainers with individuals, or used directly by individuals without a trainer. The exercise training devices may be rapidly connected to a bar and/or adjusted, without the use of tools. The devices may be quickly adjusted to a plurality of positions to immediately accommodate individuals of different sizes and skill levels, and to adjust to progress by the individual toward completing the toes to bar exercise. The devices provide an advantageous, immediate solution for an individual that needs to modify or scale the toes to bar exercise, and wishes to train to fully achieve the toes to bar movement. The device also may permit the individual to make consistent adjustments and to measure progress in training to master the exercise. The example devices provide an ideal piece of training equipment, whether owned and used by an individual or by fitness facilities.

BRIEF DESCRIPTION OF THE DRAWINGS

The above-mentioned and other features of the present disclosure, and the manner of attaining them, will become more apparent and will be better understood by reference to the following description of exemplary embodiments of the present disclosure, taken in conjunction with the accompanying drawings, wherein:

FIG. 11A is a front view of a ninth example exercise training device.

FIG. 11B is a side view of the ninth example exercise training device in an extended position.

FIG. 11C is a side view of the ninth example exercise training device in a fully retracted position.

Figure 1A:
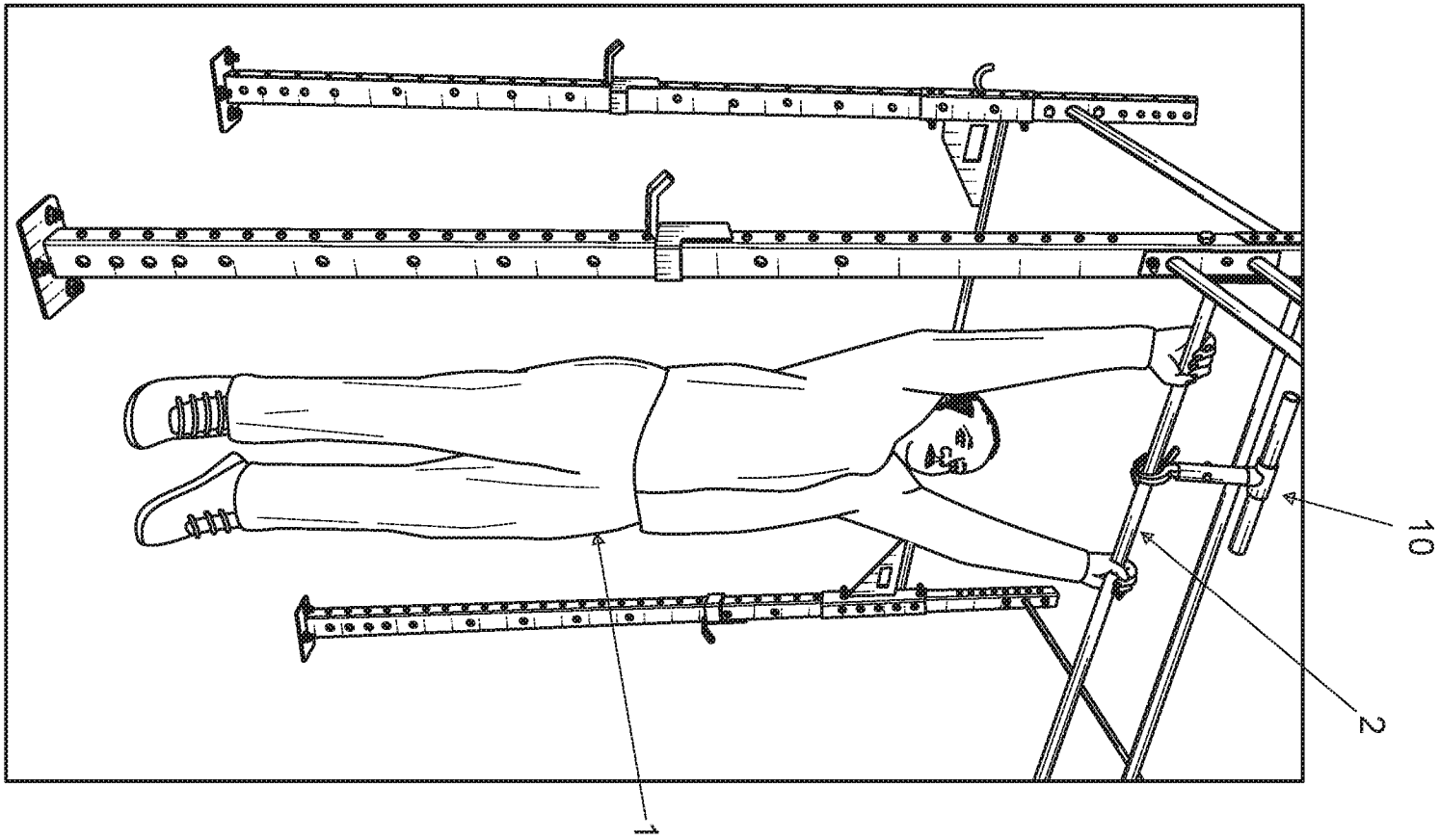
FIG. 1A is a front perspective view of an individual grasping and hanging downward from a laterally extending overhead bar, while a first example exercise training device is connected to the overhead bar and moved to a stowed position.

Corresponding or related reference numerals indicate corresponding parts throughout the several views. Although the drawings represent exemplary embodiments of the present disclosure, the drawings are not necessarily to scale and certain features may be exaggerated, removed or shown in phantom to better illustrate and explain the present disclosure or for convenience.

DETAILED DESCRIPTION

Examples of the present subject matter are disclosed herein. However, it will be understood that the disclosed examples merely are exemplary, and that exercise training devices within the scope of the appended claims may be embodied and constructed of various materials and in a variety of configurations. Therefore, specific details disclosed herein are not to be interpreted as limiting, but rather are illustrative of various aspects of the present inventive subject matter.

As described in more detail herein, the present disclosure is directed to exercise training devices that include at least one bar mounting assembly, an elongated, laterally extending target portion, and a spacer portion connected at a first end to and extending longitudinally away from the at least one bar mounting assembly, and connected at an opposed second end to the elongated, laterally extending target portion, and to methods of using such exercise training devices. In general, exercise training devices of the present disclosure are intended to be used to modify, scale or adjust a toes to bar exercise, to permit an individual to practice the exercise while hanging from a bar above the individual's head. The example devices include numerous alternative advantageous structures. It will be appreciated that such structures may be combined in a variety of ways, to yield an exercise training device having particular desired features.

Figure 1B:
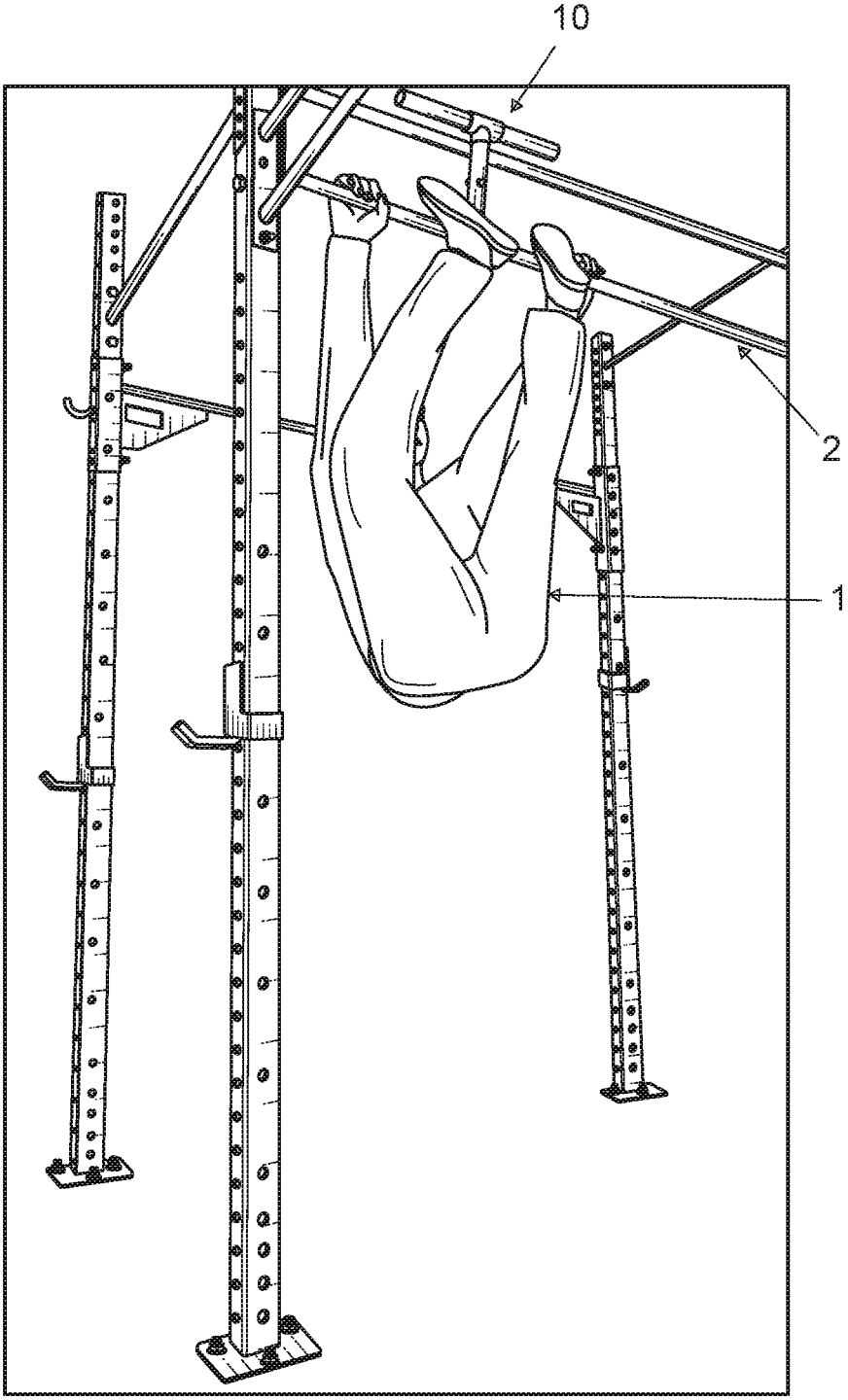
FIG. 1B is a front perspective view showing the individual in FIG. 1A successfully performing a toes to bar exercise, with the feet of the individual contacting the bar, while the first example exercise training device remains connected to the bar and in a stowed position.

FIGS. 1A and 1B show an individual preparing to attempt a toes to bar exercise and successfully raising the individual's feet to contact the bar. In FIG. 1A, the individual 1 is shown using his hands to grasp and hang from a laterally extending overhead bar 2. The individual 1 is hanging downward from the bar 2, while a first example exercise training device 10 is connected to the overhead bar 2 and located in a stowed position, above and optionally may be rearward of the bar 2. In FIG. 1B, the individual 1 has raised his toes to contact the bar 2 to successfully complete the very challenging movement.

Figure 2A:
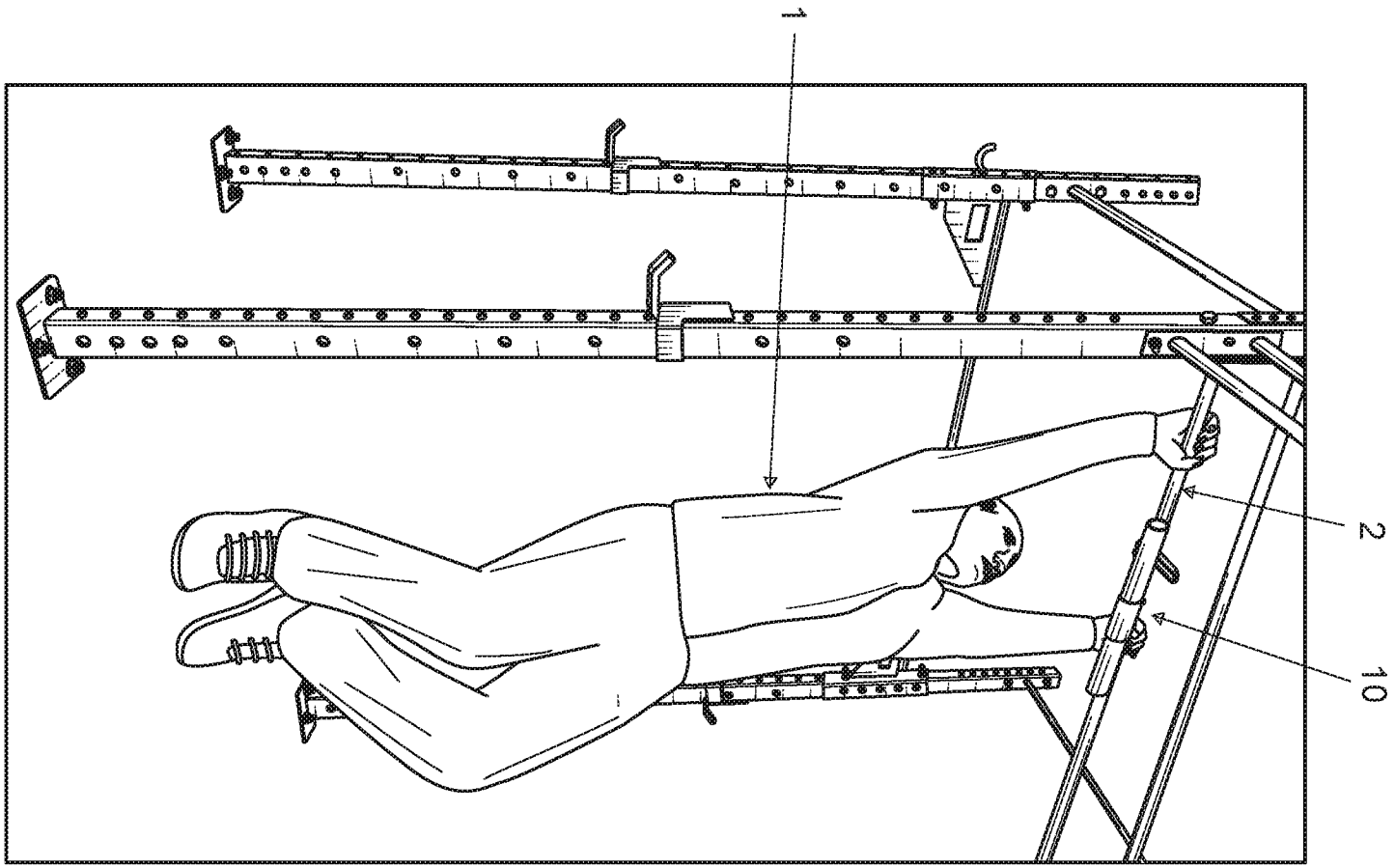
FIG. 2A is a front perspective view showing the individual in FIG. 1A practicing a toes to bar exercise, with the first example exercise training device in a position for use below and forward of the bar.
Figure 2B:
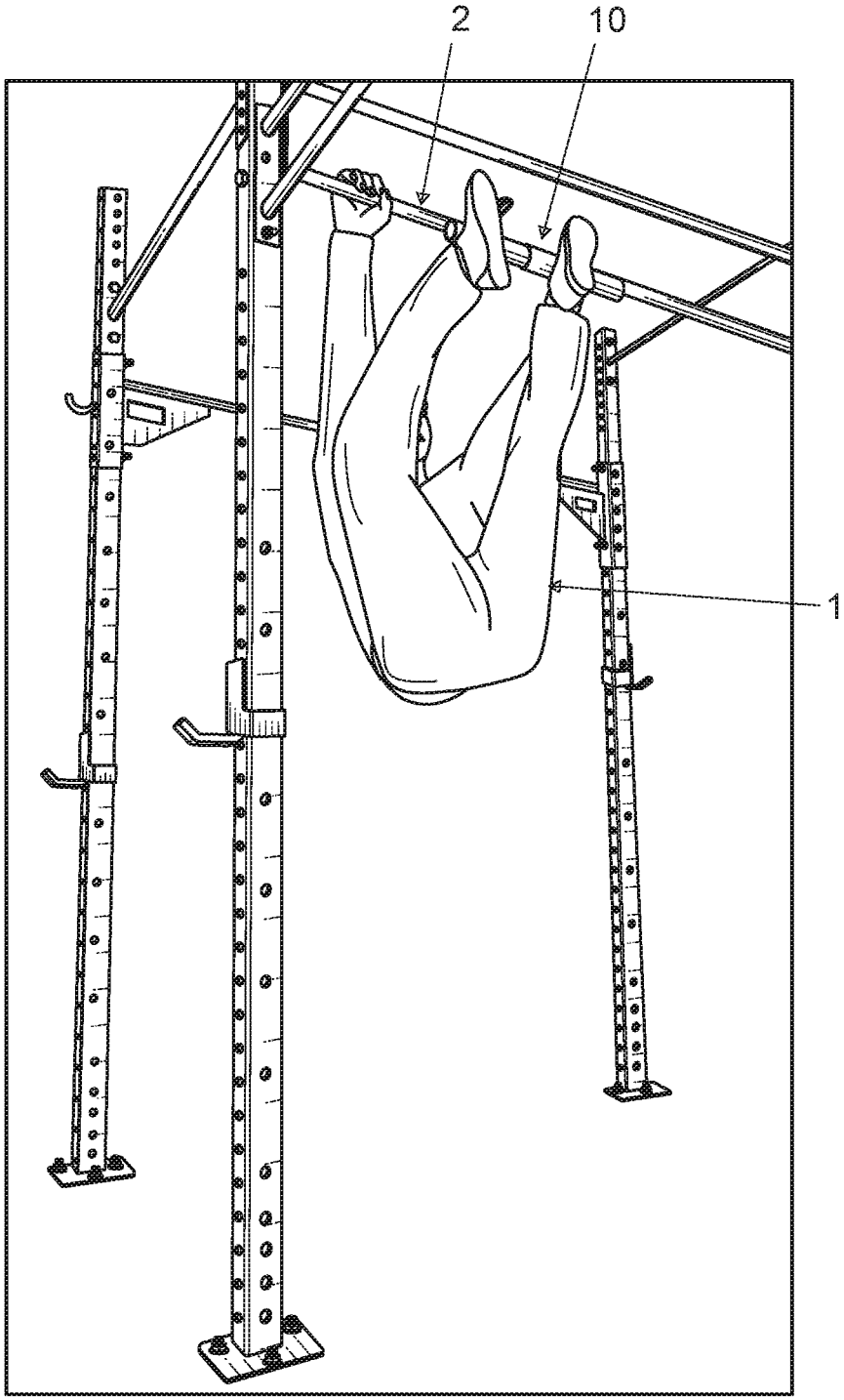
FIG. 2B is a front perspective view showing the individual in FIG. 1A, with the feet of the individual contacting a target portion of the first example exercise training device in a position for use below and forward of the bar.

FIGS. 2A and 2B represent use of the first example exercise training device 10 by an individual 1 that is not able to complete the full toes to bar movement, and may benefit by use of the exercise training device 10 to modify, scale and adjust the exercise to permit practice to develop the strength and technique to be able to achieve the full movement. In FIG. 2A, the individual 1 is starting to raise his toes to contact the first example exercise training device 10, which is in a position for use below and forward of the bar 2, representing a modification of the exercise. In FIG. 2B, the individual 1 has successfully completed the modified exercise by raising his toes to the exercise training device 10. As the individual 1 demonstrates improved proficiency, the exercise training device 10 may be selectively positioned higher and/or closer to the bar 2 to increase the difficulty and lessen the degree of modification of the exercise.

Figure 3B:
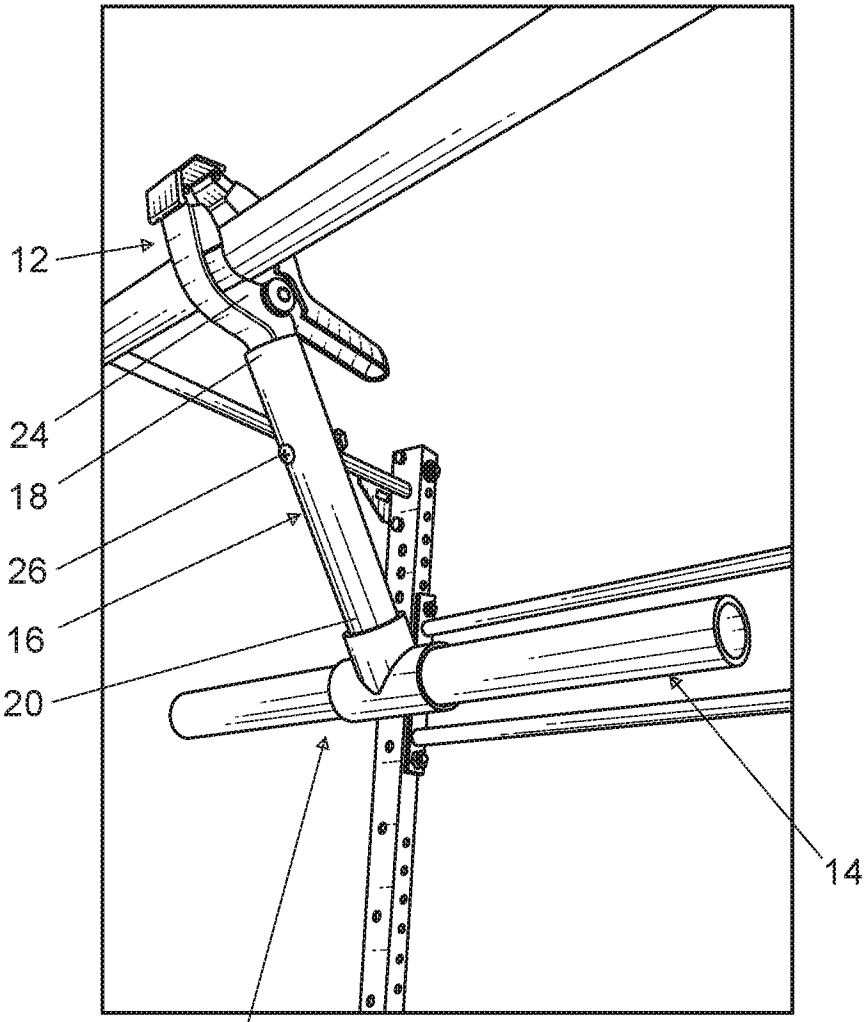
FIG. 3B is a rear perspective view of the first example exercise training device shown in FIG. 3A.
Figure 3A:
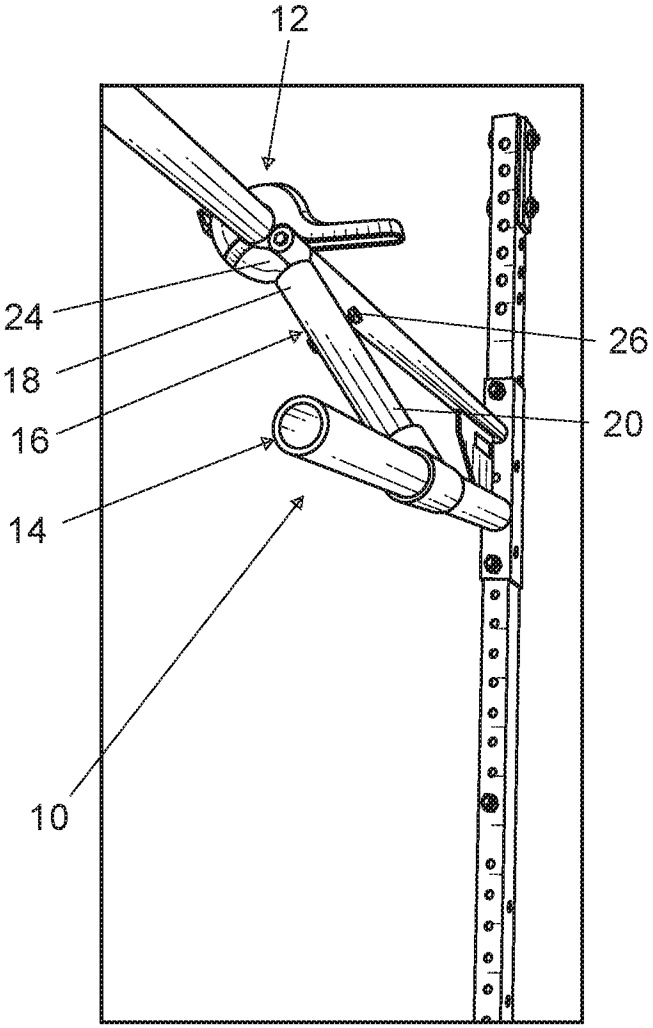
FIG. 3A is a front perspective view of the first example exercise training device of FIGS. 1A-2B, shown in a position for use below and forward of the bar.

FIG. 3A is a front perspective view showing the first example exercise training device 10 connected to the overhead bar 2 and in a position for use below and forward of the bar 2. FIG. 3B is a rear perspective view of the first example exercise training device 10, in the same position for use shown in FIG. 3A. The exercise training device 10 includes at least one bar mounting assembly 12, an elongated, laterally extending target portion 14, and at least one spacer portion 16 connected at a first end 18 to and extending longitudinally away from the at least one bar mounting assembly 12, and connected at an opposed second end 20 to the elongated, laterally extending target portion 14. The at least one bar mounting assembly 12 is in the form of a single bar mounting assembly 12 that includes a clamp 24. The clamp 24 is in the configuration of a spring clamp that has arms and/or jaws that are biased toward a closed position by a biasing member, such as a spring. Thus, the clamp 24 may be opened to receive the bar 2 and then permitted to move toward a closed position, so as to grip and maintain an angular position relative to the bar 2.

In the first example exercise training device 10, the elongated, laterally extending target portion 14 and spacer portion 16 are constructed of rigid tubing, such as plastic, metal or the like. A first end of the spacer portion 16 is connected to and extends longitudinally away from the bar mounting assembly 12 via a connection to a handle portion of the clamp 24 of the bar mounting assembly 12, which may be by any means of fastening, such as by a fastener in the form of a bolt and nut 26 or a rivet, or by other suitable means such as adhesive or the like. The opposed second end of the spacer portion 16 is connected to the elongated, laterally extending target portion 14, via inclusion of a fitting having a T-shape that receives two straight sections of tubing that form the elongated, laterally extending target portion 14. Indeed, the exercise training device 10 forms an assembly generally having a T-shape. It will be appreciated that the structure of the device 10 alternatively may include fewer components and/or integrally formed components. For instance, the spacer portion and target portion may be integrally formed as part of an extension from the bar mounting assembly. This also applies to many of the components of the other example devices disclosed herein.

In this example, the selective use position is chosen by squeezing the clamp 24 to release the gripping force of the clamp 24 and then rotating the exercise training device 10 relative to the overhead bar 2 to a desired position. Rotation of the exercise training device 10 relative to the bar 2 causes the target portion 14 to swing through an arc from below and forward of the bar 2 through potential positions for use, to above and rearward of the bar 2 to be stowed. The clamp 24 also may be squeezed sufficiently to open the clamp 24 to entirely remove the exercise training device 10 from the overhead bar 2. This first example device 10 represents a fairly simple and inexpensive version, because the bar mounting assembly 12 includes a clamp 24, which may be quickly squeezed to adjust or remove the device 10, while the target portion 14 and spacer portion 16 have fixed, non-adjustable lengths. It further will be appreciated that any of the bar mounting assemblies and their clamps disclosed herein may be used with this first example device 10, and such components may be mixed and matched as desired between the disclosed example devices.

The exercise training device 10 may be used in attempting to master the toes to bar exercise. To do so, a user may perform a method of positioning an exercise training device 10 on a laterally extending overhead bar 2 to practice a toes to bar exercise, including connecting to the laterally extending overhead bar 2 an exercise training device 10 having at least one bar mounting assembly 12, an elongated, laterally extending target portion 14, and a spacer portion 16 connected at a first end 18 to and extending longitudinally away from the at least one bar mounting assembly 12, and the spacer portion 16 connected at an opposed second end 20 to the elongated, laterally extending target portion 14, and adjusting the exercise training device 10 to extend downward and forward from the laterally extending overhead bar 2. Additionally, it will be appreciated upon reviewing this disclosure that all of the examples disclosed herein also may be utilized in practicing this method, in preparation to modify and practice the toes to bar exercise.

Figures 4A, 4B, 4C, 4D:
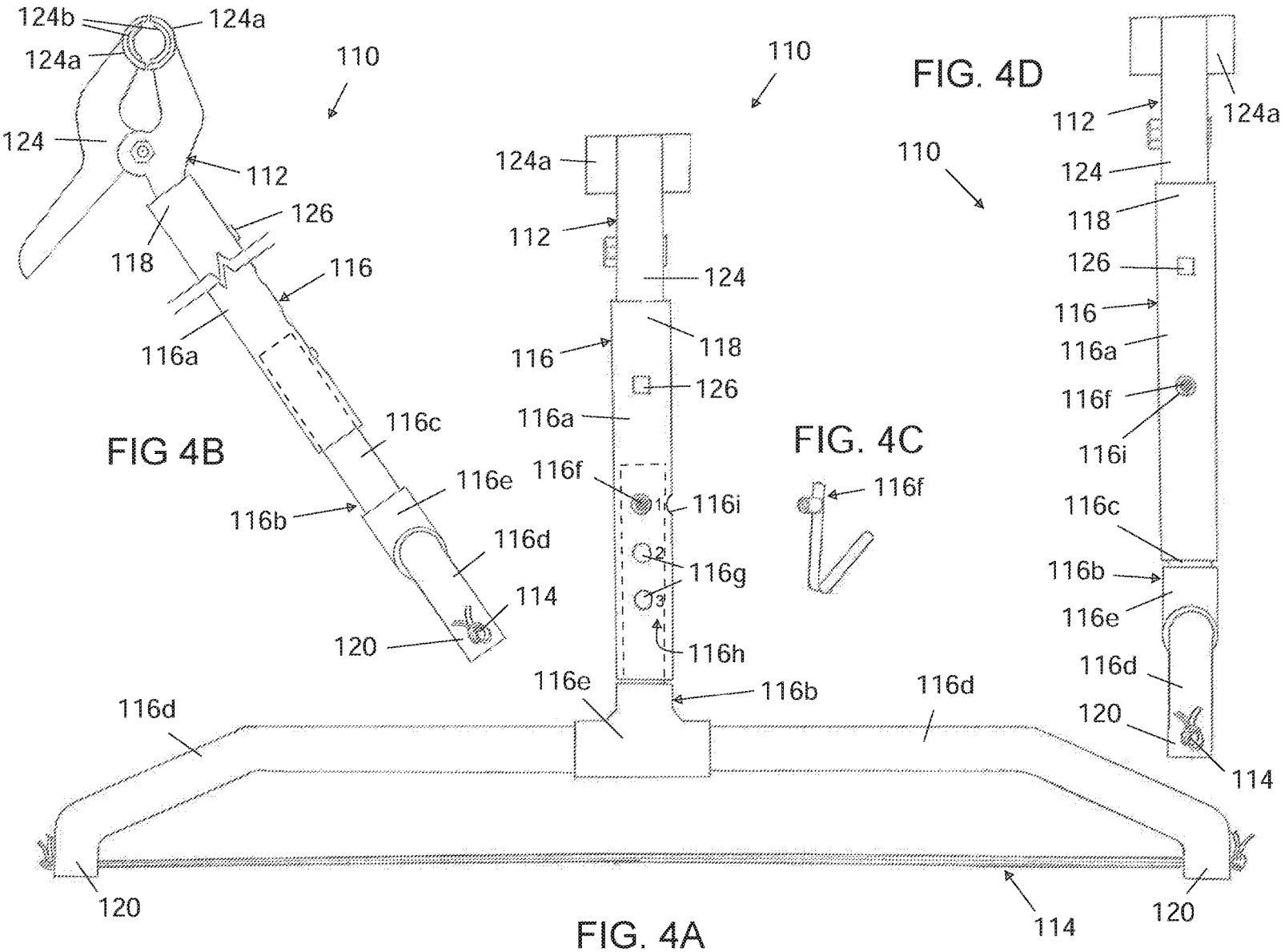
FIG. 4A is a front view of a second example exercise training device.
FIG. 4B is a side view of the second example exercise training device.
FIG. 4C is a perspective view of a spring push button that may be used in the second example exercise training device.
FIG. 4D is a side view of the second example exercise training device In a more compact stowed position.

FIGS. 4A-4D show a second example exercise training device 110 that provides additional advantageous features. FIG. 4A is a front view of the exercise training device 110 that includes at least one bar mounting assembly 112, an elongated, laterally extending target portion 114, and at least one spacer portion 116 connected at a first end 118 to and extending longitudinally away from the at least one bar mounting assembly 112, and connected at an opposed second end 120 to the elongated, laterally extending target portion 114. The device 110 forms an assembly generally having a Y-shape.

The at least one bar mounting assembly 112 is a single bar mounting assembly that includes a clamp 124. The clamp 124 is in the configuration of a spring clamp that is biased toward a closed position and which is similar to the clamp 24 of the first example, except that the clamp 124 has wider jaws 124*a* having gripping pads 124*b* to assist in maintaining the desired positions for use and to be stowed when the clamp 124 is biased to a closed position around an overhead bar. Thus, the clamp 124 may be opened to receive an overhead bar, such as the bar 2, and then permitted to be moved toward a closed position, so as to grip and maintain an adjusted angular position relative to the overhead bar. Also, it will be appreciated that alternative means of improving the grip of a clamp may be used for this or any of the other examples disclosed herein, such as integrally formed ribs or teeth in the jaws of the clamp.

In the second example exercise training device 110, the elongated, laterally extending target portion 114 is constructed of an elongated flexible material to help dissipate forces when the feet of a user contact the elongated, laterally extending target portion 114. In this example, the flexible target portion 114 may be a generally inelastic element, such as a cord, wire or the like, or may be a resilient member, such as an elastic cord, band or the like, which may more readily absorb or dissipate such forces. It will be appreciated, however, that the target portion 114 alternatively may include a rigid member, such as a rod or tube.

In the example device 110, the second end 120 of the spacer portion 116 includes two portions, both of which are labeled 120, for convenience. The target portion 114 extends between the two portions of the second end 120 of the spacer portion 116. In this second example, the spacer portion 116 is primarily constructed of rigid tubing, made of one or more materials such as plastic, metal or the like. However, it will be appreciated that somewhat flexible materials could be used. The spacer portion 116 of this example includes at least one first member 116*a* that includes the first end 118 of the spacer portion 116 that is connected to and extends longitudinally away from the bar mounting assembly 112 via a connection to a handle portion of the clamp 124, which may be by any means of fastening, such as by a fastener in the form of a rivet 126 or a bolt and nut, or by other suitable means such as adhesive, integral forming or the like. It also will be appreciated that the first member could be connected to the clamp by being integrally formed with and extending from the clamp. The spacer portion 116 further includes at least one second member 116*b* connected to the elongated, laterally extending target portion 114, with the at least one second member 116*b* in this second example including a straight portion 116*c* connected to two curved portions 116*d* via a fitting 116*e* having a T-shape, such that the exercise training device 110 forms an assembly generally having a Y-shape. The opposed second end 120 of the spacer portion 116 includes ends of the two curved portions 116*d*, with the elongated, laterally extending target portion 114 extending between and connected to the two curved portions 116*d* at the second end 120.

In this second example, the spacer portion 116 is telescopic and adjustable in length. Being adjustable in length within this disclosure, means that an example device can be adjusted at least from a first position that is retracted to a second position that is extended. The second example device 110 happens to be adjustable in length between three different positions. The first member 116*a* is tubular and is of a first size that slidably receives the straight portion 116*c* of the at least one second member 116*b* that is connected to the elongated, laterally extending target portion 114. The straight portion 116*c* is tubular and has a size in cross section that is relatively smaller and fits within the tubular first member 116*a*. The straight portion 116*c* also includes a spring push button 116*f*, such as is shown in FIG. 4*c*, which is used to selectively engage one of a plurality of apertures 116*g* in the straight first member 116*a* to adjust the length of the spacer portion 116. The straight member 116*a* also includes indicia 116*h* relating to the plurality of adjustable length positions, which permit a user to keep track of the way in which the length of the exercise training device 110 has been adjusted, so as to be able to rapidly return to the same adjusted position or to choose a new adjusted position, as desired. Such indicia may be in the form of a scale, spaced markings and/or lettering or numbering.

Thus, with the second example, any of the three adjustable length positions may be chosen when the exercise training device 110 is configured as shown in FIG. 4B for connection to a laterally extending overhead bar that will be parallel to the elongated, laterally extending target portion 114, and for rotation to a use position below and forward of the bar or to a stowed position above and rearward of the bar. When the clamp 124 is squeezed, rotation of the exercise training device 110 relative to an overhead bar causes the target portion 114 to swing through an arc from below and forward of the bar through potential positions for use, to above and rearward of the bar to be stowed. However, the adjustable length of the spacer portion 116 permits a greater variety of use and stowed positions along multiple potential arcs, closer to or farther away from the overhead bar.

As best seen in FIGS. 4A and 4D, the straight portion 116*c* also includes an aperture 116*i* through a side thereof. When the spring push button 116*f* is depressed, the at least first member 116*a* of the spacer portion 116 is separable from and rotatable relative to the straight portion 116*c* of the at least one member 116*b* that is connected to the elongated, laterally extending target portion 114. The spacer portion 116*c* then can be disassembled, such as for packaging, or the aperture 116*h* may be used to lock the first member 116*a* in a retracted position that also is rotated 90 degrees, so as to reduce the volume needed to ship or stow the exercise training device 110 when it is not connected to an overhead bar. It will be appreciated that the use of tubular components in any of the example devices disclosed herein may include any tubular shape, whether cylindrical, square or otherwise. Also, if not cylindrical, it may be that the tubular first member still can be removed, rotated 90 degrees and reconnected, such as may be possible with square tubing. Thus, the second example exercise training device 110 is quickly and highly adjustable for use by individuals of various sizes and abilities, as well as for more compact shipping and stowage.

Figure 5A:
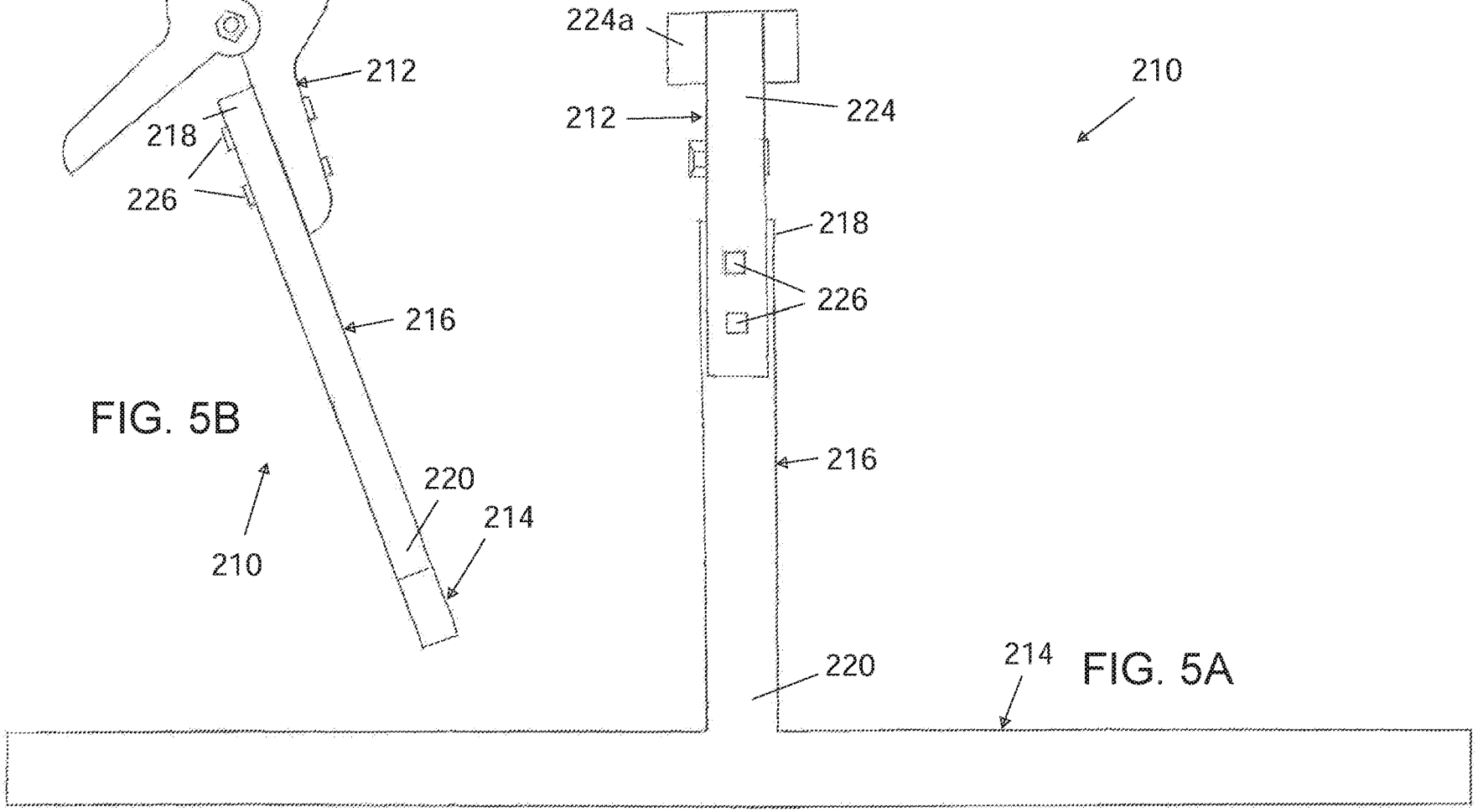
FIG. 5A is a front view of a third example exercise training device.
Figure 5B:
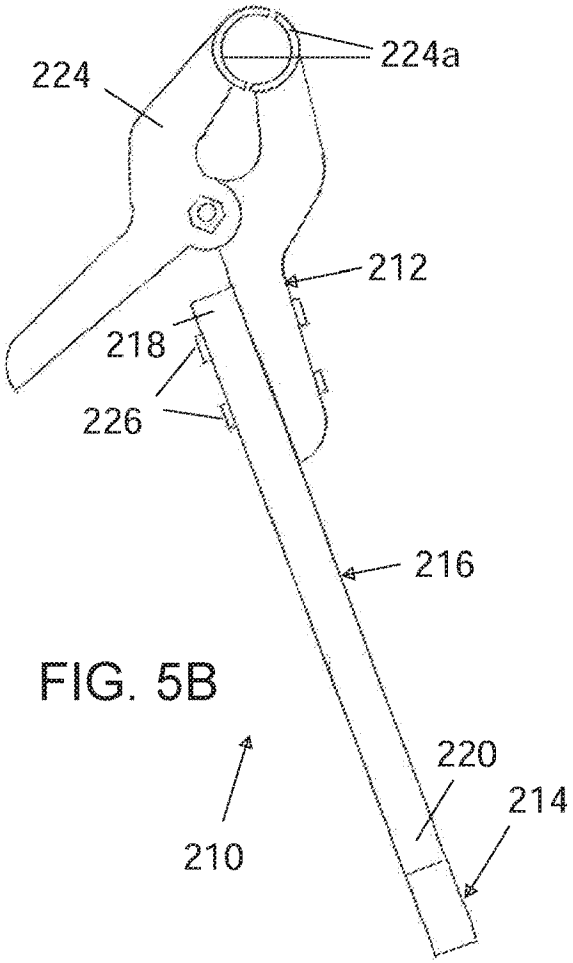
FIG. 5B is a side view of the third example exercise training device.

Turning to FIGS. 5A and 5B, a third example exercise training device 210 is shown in a front view and a side view, respectively. The exercise training device 210 includes at least one bar mounting assembly 212, an elongated, laterally extending target portion 214, and at least one spacer portion 216 connected at a first end 218 to and extending longitudinally away from the at least one bar mounting assembly 212, and connected at an opposed second end 220 to the elongated, laterally extending target portion 214. The device 210 forms an assembly generally having a T-shape.

The at least one bar mounting assembly 212 includes a clamp 224, which is in the configuration of a spring clamp that is biased toward a closed position. Similar to the clamp 124 in the second example, the clamp 224 of this third example has wider jaws 224*a* and may be opened to receive an overhead bar, such as the bar 2, and then permitted to move toward a closed position, so as to grip and maintain an angular position relative to the bar, whether a desired position for use below and forward of the bar, or a position to be stowed above and rearward of the bar.

In the third example exercise training device 210, a first end 218 of the spacer portion 216 is connected to and extends longitudinally away from the bar mounting assembly 212 via a connection to a handle portion of the clamp 224, which may be by any means of fastening, such as by at least one fastener in the form of a rivet 226 or a bolt and nut, or by other suitable means such as adhesive or the like. The elongated, laterally extending target portion 214 and spacer portion 216 are of integral construction and may be made of generally rigid flat stock, such as of molded plastic, wood, metal or the like. It will be appreciated that the target and spacer portions may be integrally constructed with the clamp of the bar mounting assembly.

In this example, the selective use position is chosen by squeezing the clamp 224 to release the gripping force of the clamp 224 and then rotating the exercise training device 210 relative to the overhead bar to a desired position. Rotation of the exercise training device 210 relative to the bar causes the target portion 214 to swing through an arc from below and forward of the bar through potential positions for use, to above and rearward of the bar to be stowed. The clamp 224 also may be squeezed sufficiently to open the clamp 224 to entirely remove the exercise training device 210 from the overhead bar. This third example device 210 represents a fairly simple and inexpensive version, because the at least one bar mounting assembly 212 includes a clamp 224 that may be quickly squeezed to adjust or remove the device 210, while the target portion 214 and spacer portion 216 are of integral construction and have fixed, non-adjustable lengths. Indeed, it will be appreciated that the integral forming actually also may include the spacer portion being formed with and extending from the clamp of the bar mounting assembly, which could be utilized for this example, as well as the other examples disclosed herein.

Figures 6A, 6B:
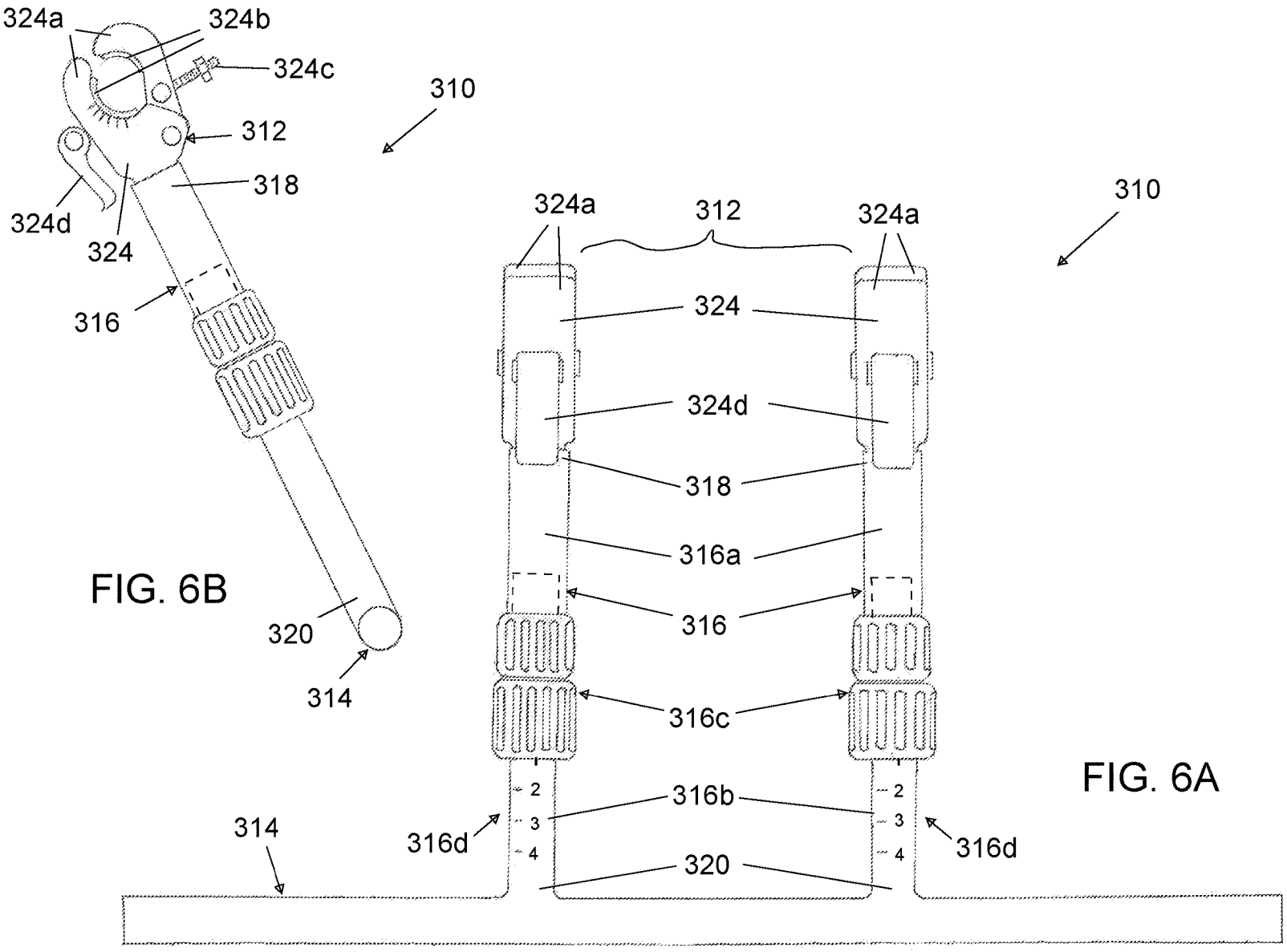
FIG. 6A is a front view of a fourth example exercise training device.
FIG. 6B is a side view of the fourth example exercise training device.

A fourth example exercise training device 310 is shown in front view FIG. 6A and side view 6B. The exercise training device 310 includes at least one bar mounting assembly 312, an elongated, laterally extending target portion 314, and at least one spacer portion 316 connected at a first end 318 to and extending longitudinally away from the at least one bar mounting assembly 312, and connected at an opposed second end 320 to the elongated, laterally extending target portion 314. The device 310 forms an assembly generally having a T-shape.

The device 310 has at least one bar mounting assembly 312, which in the fourth example includes two bar mounting assemblies 312. Each bar mounting assembly 312 includes a clamp 324, which has a pair of pivotally connected jaws 324*a*, with gripping pads 324*b* to assist in maintaining the desired positions for use and to be stowed, and a rotatable fastener 324*c* that can be rotated by a handle 324*d* at one end, so as to open or close the jaws 324*a* and to adjust the gripping force of the clamp 324. Thus, the clamp 324 may be opened to receive an overhead bar, such as the overhead bar 2, and then the handle 324*d* can be rotated to move the clamp jaws 324*a* toward a closed position, so as to grip and maintain an adjusted angular position relative to the overhead bar. Each bar mounting assembly 312 of this fourth example device 310 also includes indicia 324*e* along the side of the clamp 324 adjacent to where the clamp 324 grips a bar. Such indicia may include a scale, lettering or enumeration as desired to assist in tracking the angular position, such as relative to a bottom center point on the bar, which is useful in training and to readily return to a previously utilized position. It also will be appreciated that such indicia at a bar mounting assembly advantageously may be incorporated into any of the other examples disclosed herein.

Each first end 318 of the spacer portion 316 is connected to and extends longitudinally away from a bar mounting assembly 312 via a connection to a portion of the clamp 324, which may be by any means of fastening, such as by use of adhesive, a fastener or the like. In this fourth example, the spacer portion 316 is telescopic and adjustable in length. Each first member 316*a* of the spacer portion 316 is tubular, has a first size and slidably receives a straight member 316*b* of the spacer portion 316 that has a relatively smaller second size and is connected to the elongated, laterally extending target portion 314. In the fourth example, the elongated, laterally extending target portion 314 is of integral construction with two straight members 316*b* of the spacer portion 316, and may be tubular or solid and constructed of plastic, metal or other suitable materials. The second end 320 of the spacer portion 316 includes two portions, both of which are labeled 320, for convenience.

The target portion 314 extends laterally outward beyond the connection to the two second ends 320 of the spacer portion 316. In this fourth example, the spacer portion 316 also includes two collar twist clamps 316*c* that permit the telescopic length of the spacer portion 316 to be adjusted to any desired length to suit the user. The straight members 316*b* also include indicia 316*d* relating to adjustable length positions, such as was shown with other examples, which permits a user to keep track of the way in which the length of the exercise training device 310 has been adjusted, so as to be able to rapidly return to the same adjusted position or to choose a new adjusted position, as desired.

Thus, with the fourth example, a variety of adjustable length positions may be chosen when the exercise training device 310 is configured as shown in FIGS. 6A and 6B for connection to a laterally extending overhead bar that will be parallel to the elongated, laterally extending target portion 314, and for rotation to a use position below and forward of the bar or to a stowed position above and rearward of the bar. When the clamp 324 is opened, rotation of the exercise training device 310 relative to an overhead bar causes the target portion 314 to swing through an arc from below and forward of the bar through potential positions for use, to above and rearward of the bar to be stowed. However, the adjustable length of the spacer portion 316 permits a greater variety of use and stowed positions along multiple potential arcs, closer to or farther away from the overhead bar.

Each collar twist clamp 316*c* also permits an at least first member 316*a* of the spacer portion 316 to be separated from and rotatable relative to at least one straight member 316*b* of the spacer portion 316 by use of the collar twist clamps 324. The first members 316*a* can be disassembled from the integral spacer portion 316 and elongated, laterally extending target portion 314. The collar twist clamps 316*c* also permit each first member 316*a* to be rotated 90 degrees, so as to remain connected but reduce the volume needed to ship or stow the exercise training device 310 when it is not connected to an overhead bar. Thus, the fourth example exercise training device 310 is quickly and highly adjustable for use by individuals of various sizes and abilities, as well as for more compact shipping and stowage.

Figures 7A, 7B:
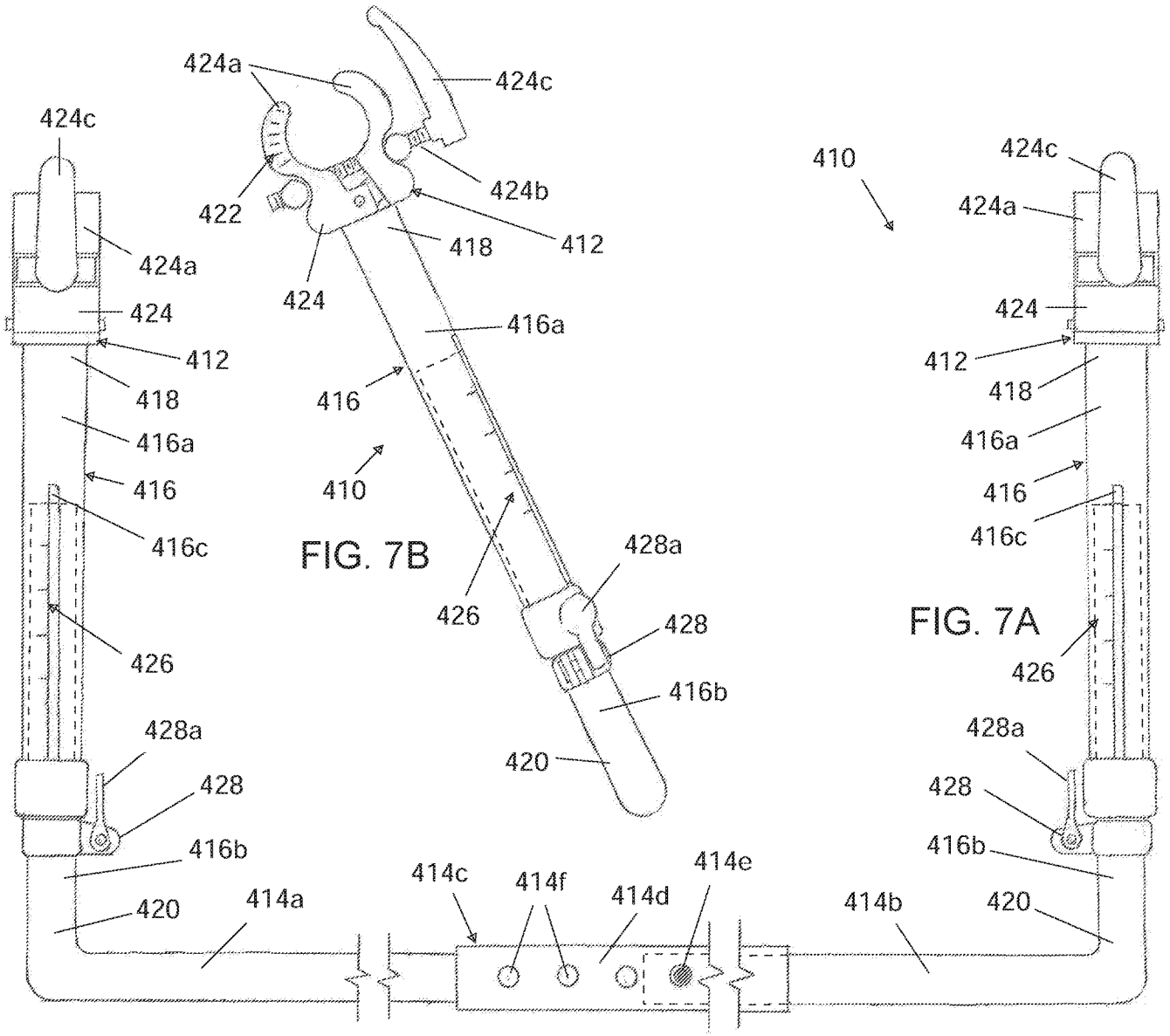
FIG. 7A is a front view of a fifth example exercise training device.
FIG. 7B is a side view of the fifth example exercise training device.

FIGS. 7A and 7B provide front and side views, respectively, of a fifth example exercise training device 410. The exercise training device 410 includes at least one bar mounting assembly 412, an elongated, laterally extending target portion 414, and at least one spacer portion 416 connected at a first end 418 to and extending longitudinally away from the at least one bar mounting assembly 412, and connected at an opposed second end 420 to the elongated, laterally extending target portion 414. In this fifth example, the at least one bar mounting assembly includes two bar mounting assemblies 412, and the spacer portion 416 includes separate telescopic assemblies, with the elongated, laterally extending target portion 414 extending between the two bar mounting assemblies 412, so as to have the device 410 form an assembly generally having a U-shape.

The two bar mounting assemblies 412 each include a clamp 424, which has a pair of pivotally connected jaws 424*a*, and a rotatable fastener 424*b* that can be rotated by a handle 424*c* at one end, so as to open or close the jaws 424*a* and to adjust the gripping force of the clamp 424. Thus, the clamp 424 may be opened to receive an overhead bar, such as the overhead bar 2, and then the handle 424*c* can be rotated to move the clamp jaws 424*a* toward a closed position, so as to grip and maintain an adjusted angular position relative to the overhead bar. It also will be appreciated that each clamp of this example or others disclosed herein could be of the type that has a cam lever, so as to simply pivot the lever to adjust the clamp from being released for angular adjustment relative to the bar, to a position where the clamp is tightened to hold the clamp in place. Each bar mounting assembly 412 also includes indicia 422 along the side of the clamp 424 adjacent to where the clamp 424 grips a bar. Such indicia may include a scale, lettering or enumeration as desired to assist in tracking the angular position, such as relative to a bottom center point on the bar, which is useful in training and to readily return to a previously utilized position Each first end 418 of spacer portion 416 is connected to and extends longitudinally away from a bar mounting assembly 412 via a connection to a portion of a clamp 424, which may be by any means of fastening, such as by use of adhesive, a fastener or the like. In this fifth example, the spacer portion 416 is telescopic and adjustable in length. Each first member 416*a* of the spacer portion 416 is tubular, has a first size and slidably receives a straight portion 416*b* of the spacer portion 416 that has a second relatively smaller size and is connected to the elongated, laterally extending target portion 414. The tubular first member 416*a* may be constructed of plastic, metal or other suitable materials. The first members 416*a* may include indicia 426 to assist in setting the adjusted length of the spacer portion 416 for consistent use and to track progress. The first members 416*a* also may include a slot 416*c* that permits viewing of the position of the straight members 416*b* as they are slidably received by the first members 416*a*. Other examples disclosed herein also may use indicia and/or a slot to better view the adjusted positions. The first members 416*a* also include collar compression clamps 428 that squeeze the straight members 416*b* when the handle 428*a* is rotated to apply compression.

In the fifth example, the elongated, laterally extending target portion 414 also is adjustable in length by including a first end 414*a* that is of integral construction with one of the straight members 416*b*, and a second end 414*b* that is of integral construction with another of the straight members 416*b*, where the integral constructions are tubular or solid and made of plastic, metal or other suitable material. The adjustable target portion 414 also includes an adjustment assembly 414*c* having an adjustment tube 414*d* constructed of any of the same types of material and connected to the second end 414*b* and slidably receiving the first end 414*a*. The adjustment tube 414*d* includes a series of apertures 414*f* and first end 414*a* includes a spring push button 414*e* that engages one of the apertures 414*f*. When the spring push button 414*e* is depressed, the length of the elongated, laterally extending target portion 414 may be adjusted to better accommodate the width of the user, or the device may be disassembled for more compact shipping or stowage.

Thus, with the fifth example, a variety of adjustable length positions may be chosen when the exercise training device 410 is configured as shown in FIGS. 7A and 7B for connection to a laterally extending overhead bar that will be parallel to the elongated, laterally extending target portion 414, and for rotation to a use position below and forward of the bar or to a stowed position above and rearward of the bar. When the handles 424*c* of the clamps 424 are rotated to release the gripping force of the clamps 424, rotation of the exercise training device 410 relative to an overhead bar causes the target portion 414 to swing through an arc from below and forward of the bar through potential positions for use, to above and rearward of the bar to be stowed. However, the adjustable length of the spacer portion 416 permits a greater variety of use and stowed positions along multiple potential arcs, closer to or farther away from the overhead bar.

Indeed, each collar compression clamp 428 also permits an at least first member 416*a* of the spacer portion 416 to be separated from and rotatable relative to at least one straight member 416*b* of the spacer portion 416 by use of the collar compression clamps 424. The first members 416*a* can be disassembled from the straight members 416*b* and the elongated, laterally extending target portion 414. The collar compression clamps 428 also permit each first member 416*a* to be rotated 90 degrees, so as to remain connected but reduce the volume needed to ship or stow the exercise training device 410 when it is not connected to an overhead bar. Thus, the fifth example exercise training device 410 is quickly and highly adjustable for use by individuals of various sizes and abilities, as well as for more compact shipping and stowage.

Figures 8A, 8B:
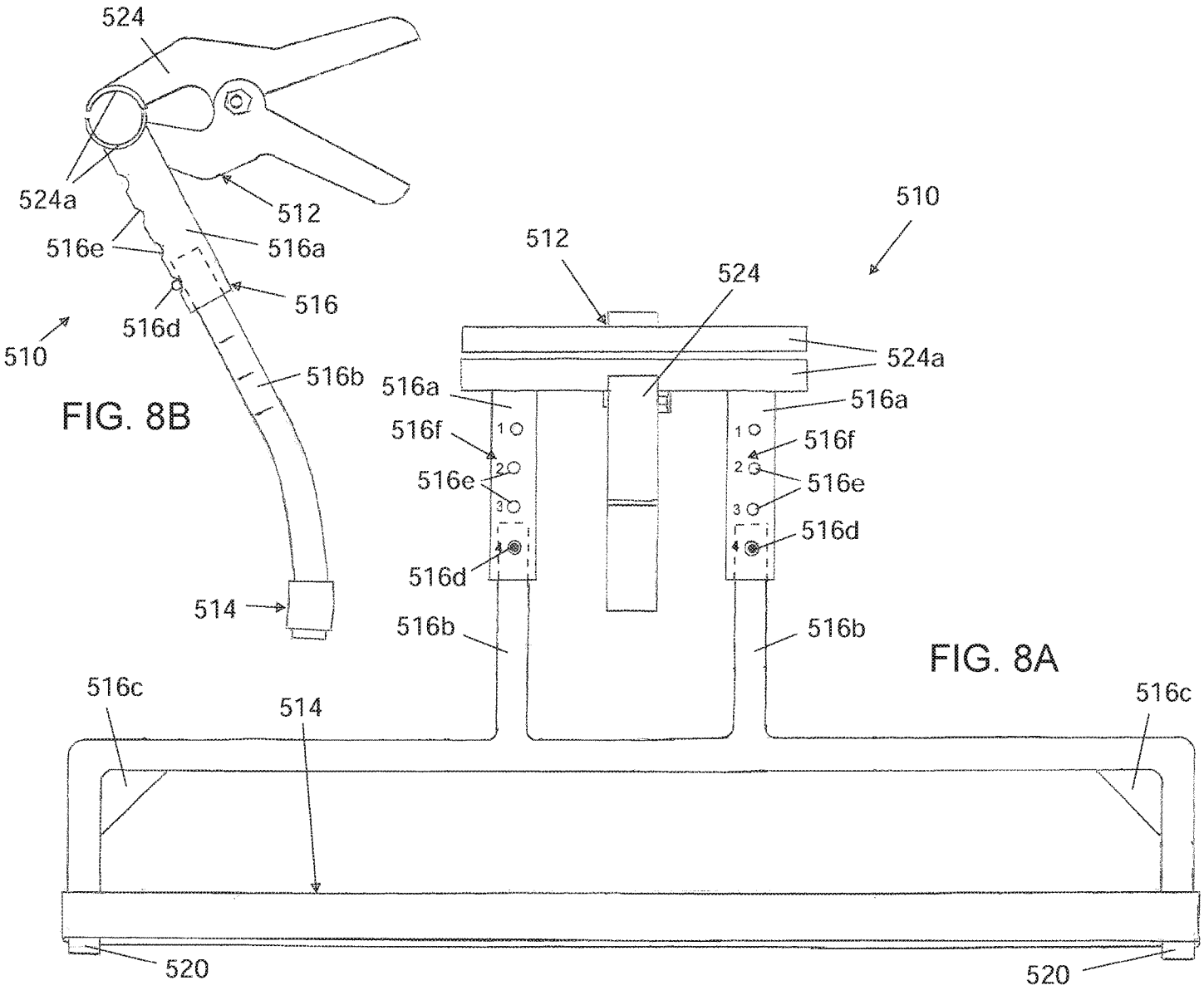
FIG. 8A is a front view of a sixth example exercise training device.
FIG. 8B is a side view of the sixth example exercise training device.

FIGS. 8A and 8B show a sixth example exercise training device 510 that includes advantageous features. FIG. 8A is a front view of the exercise training device 510 that includes at least one bar mounting assembly 512, an elongated, laterally extending target portion 514, and at least one spacer portion 516 connected at a first end 518 to and extending longitudinally away from the at least one bar mounting assembly 512, and connected at an opposed second end 520 to the elongated, laterally extending target portion 514. The device 510 forms an assembly generally having a Y-shape.

The at least one bar mounting assembly 512 of this sixth example includes a clamp 524, which is in the configuration of a spring clamp that is biased toward a closed position and which is similar to the clamp 224 of the third example, except that the clamp 524 has much wider jaws 524*a*, which assist in maintaining the desired angular positions relative to an overhead bar, such as bar 2, when the clamp 524 is biased to a closed position around the bar. As part of the bar mounting assembly 512, the clamp 524 may be connected to the wider jaws 524*a* by any means of fastening, such as by adhesive, a fastener or the like, or may be integrally formed with the wider jaws.

The wider jaws 524*a* also provide a stable base to help resist movement when a user's feet contact the elongated, laterally extending target portion 514. Thus, the clamp 524 may be opened to receive an overhead bar and then permitted to move toward a closed position, so as to grip and maintain an adjusted angular position relative to the overhead bar. To enhance the ability of a clamp to hold its position, it will be appreciated that the gripping pads shown with other examples, or integrally formed ribs or teeth may be used on this and any other of the examples disclosed herein. Similarly, narrower or wider jaws may be used on any of the clamps that are to be connected to an overhead bar with any of the examples disclosed herein.

In the sixth example exercise training device 510, the elongated, laterally extending target portion 514 is constructed of an elongated flexible material to help dissipate forces when the feet of a user contact the elongated, laterally extending target portion 514. In this example, the flexible target portion 514 may be a resilient element, such as a band, and is shown configured as a continuous loop, which may be quickly assembled to or removed from the device 510. It will be appreciated that the target portion alternatively may be configured as an alternative resilient element, such as a spring or the like, or an inelastic element, such as a cord, wire or the like, or as a rigid member, such as a rod, bar, tube or the like.

In the example device 510, the spacer portion 516 is telescopic and adjustable in length. The spacer portion 516 includes two first members 516*a* that are tubular and straight, wherein each has a first size and slidably receives a straight portion of member 516*b* of the spacer portion 516 that has a second smaller size and is connected at an opposite end 520 to the elongated, laterally extending target portion 514. The straight members 516*a* may be constructed of plastic, metal or other suitable materials, and are connected at first ends 518 to the bar mounting assembly 512, such that the spacer portion 516 is connected to and extends longitudinally away from the bar mounting assembly 512. The connection may be by any means of fastening, such as by use of adhesive, a fastener, integral forming or the like.

In this sixth example, the two members 516*b* of the spacer portion 516 have a straight portion that is received by first members 516*a* and a curved portion that extends to an end 520 that may beneficially assist in locating the elongated, laterally extending target portion 514 below and forward of an overhead bar when in a position for use. In the sixth example, the elongated, laterally extending target portion 514 is connected to the ends 520 of the integrally constructed two members 516*b* of the spacer portion 516, which also extend laterally outward before presenting the curved portion. The two members 516*b* may be tubular or solid and constructed of plastic, metal or other suitable materials. The second end 520 of the spacer portion 516 includes two portions, both of which are labeled 520, for convenience. The resilient band of the elongated, laterally extending target portion 514 extends around the second ends 520 of the spacer portion 516. To help stiffen the spacer portion 516, so as to resist bending inward at the ends 520, the spacer portion of the sixth example 510 also includes gussets 516*c*, which may be constructed of a similar material to the members 516*b*. The gussets 516*c* may be connected by any suitable means, such as by adhesive, welding or the like, or may be integrally formed with the members 516*b* and ends 520.

In this sixth example, the spacer portion 516 also includes two spring push buttons 516*d* within the straight portions of members 516*b* and which are used to selectively engage apertures 516*e* in the first members 516*a* to adjust the length of the spacer portion 516. The straight members 516*a* also include indicia 516*f*, which may be similar to that of other examples. The indicia may relate to the adjustable length positions, which permit a user to keep track of the way in which the length of the exercise training device 510 has been adjusted, so as to be able to rapidly return to the same adjusted position or to choose a new adjusted position, as desired.

Thus, with the sixth example, a variety of adjustable length positions, from a retracted to one or more extended positions may be chosen when the exercise training device 510 is configured as shown in FIGS. 8A and 8B. The device 510 may be connected to a laterally extending overhead bar that will be parallel to the elongated, laterally extending target portion 514, and for rotation to a use position below and forward of the bar or to a stowed position above and rearward of the bar. When the clamp 524 is opened, rotation of the exercise training device 510 relative to an overhead bar causes the target portion 514 to swing through an arc from below and forward of the bar through potential positions for use, to above and rearward of the bar to be stowed. However, the adjustable length of the spacer portion 516 permits a greater variety of use and stowed positions along multiple potential arcs, closer to or farther away from the overhead bar. The clamp 524 also may be squeezed sufficiently to open the clamp 524 to entirely quickly remove the exercise training device 510 from the overhead bar. By depressing the spring push buttons 516*d*, the members 516*b* and elongated, laterally extending target portion 514 then may be separated from the bar mount 512 and first members 516*a* of the spacer portion 516, such as for more convenient shipping and stowage.

Figures 9A, 9B, 9C:
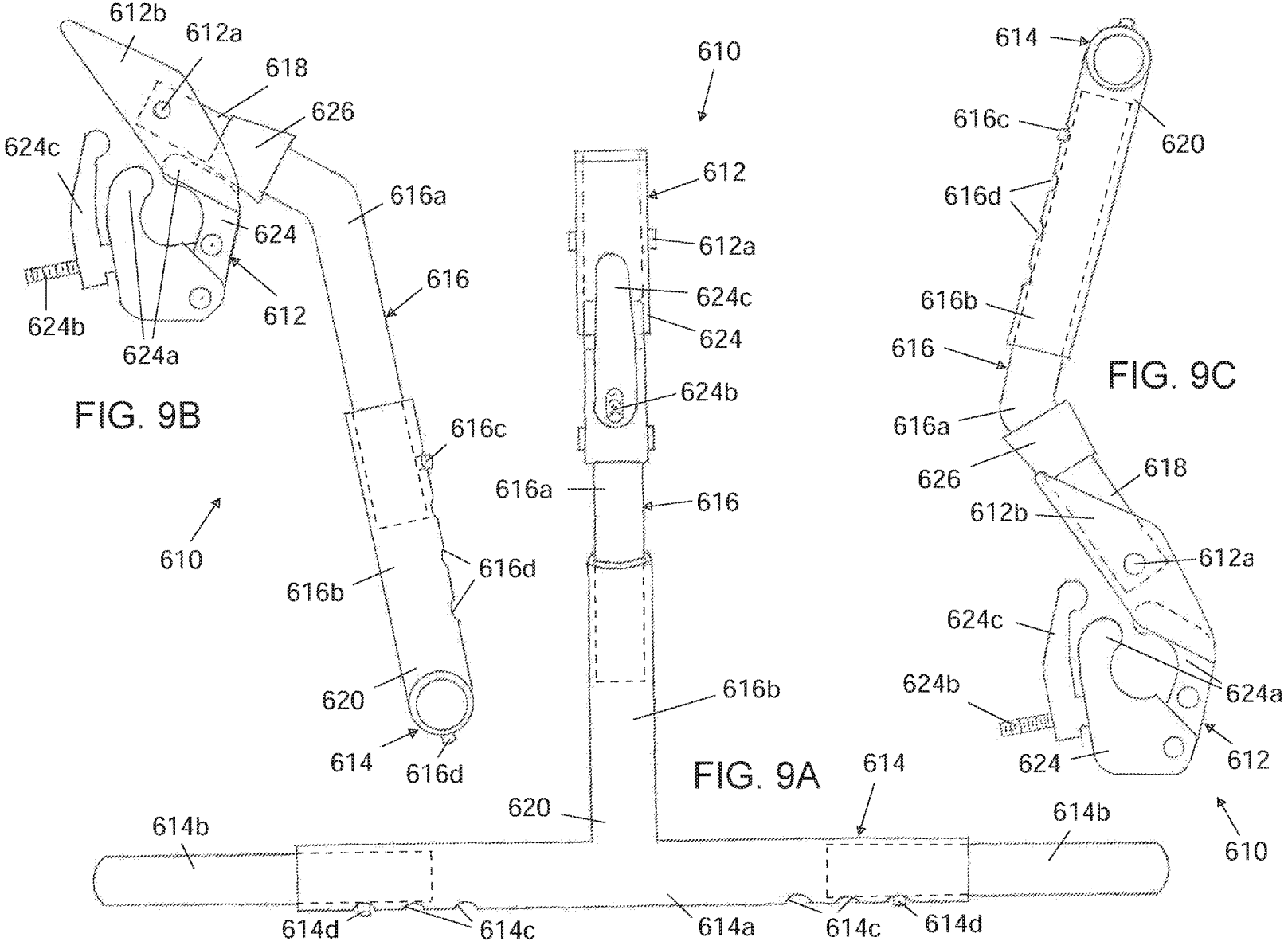
FIG. 9A is a front view of a seventh example exercise training device.
FIG. 9B is a side view of the seventh example exercise training device pivoted to a first selected position for use when connected to an overhead bar.
FIG. 9C is a side view of the seventh example exercise training device pivoted to a second selected position to be stowed when connected to an overhead bar.

Turning to a seventh example exercise training device 610, a front view is shown in FIG. 9A and two side views are shown in FIGS. 9B and 9C. The exercise training device 610 includes at least one bar mounting assembly 612, an elongated, laterally extending target portion 614, and at least one spacer portion 616 connected at a first end 618 to and extending longitudinally away from the at least one bar mounting assembly 612, and connected at an opposed second end 620 to the elongated, laterally extending target portion 614. The device 610 forms an assembly generally having a T-shape.

The at least one bar mounting assembly 612 includes a single clamp 624 that is intended to be connected to an overhead bar, such as the bar 2. Unlike the previous examples, the clamp 624 of the bar mounting assembly 612 is initially connected to an overhead bar and then the spacer portion 616 and elongated, laterally extending target portion 614 are pivoted about pivot 612*a* from a position for use below and forward of the bar, such as shown in FIG. 9B, to a position to be stowed above and rearward of the bar, such as shown in FIG. 9C, without having to release the gripping force of the clamp 624.

The clamp 624 includes a pair of pivotally connected jaws 624*a*, and a fixed threaded fastener 624*b*, as well as a rotatable fastener 624*c* configured as a handle that is rotatable on and threadably engages the fastener 624*b* to move the jaws 624*a* to apply a gripping force to connect the clamp 624 to the overhead bar. When rotated in the opposite direction, the handle 624*c* opens the jaws 624*a* to initially get the clamp 624 onto or off of the bar, and releases the gripping force to angularly position the clamp 624 relative to the bar. The spacer portion 616 includes a first member 616*a* having a straight portion near the first end 618 that is pivotally connected to the bar mounting assembly 612 at a pivot 612*a* that extends between sidewalls 612*b* that are connected to the sides of the clamp 624. A wedge collar 626 slidably receives and can be moved along the first member 616*a* proximate the first end 618 to quickly and conveniently adjust the angle at which the spacer portion 616 comes to rest when the elongated, laterally extending target portion 614 is pivoted to a position of use below and forward of the overhead bar to which the device 610 is connected, as seen in FIG. 9B, as well as when it is pivoted upward and reward to a position to be stowed while using the overhead bar for other exercises, as seen in FIG. 9C. When the user wishes to move the device to a stowed position, the clamp 614 need not be released, because the spacer portion 616 and target portion 614 simply may be pivoted about pivot 612*a* to a stowed position above and rearward of the bar.

The first member 616*a* of the spacer portion 616 also includes a bend that helps to advantageously position the target portion 614 when in a position below and forward of the bar. The first member 616*a* further is slidably received by a tubular second member 616*b* of the spacer portion 616. The first member 616*a* is tubular and includes a spring push button 616*c* which may engage any of the apertures 616*d* in the second member 616*b*. Thus, the spacer portion 616 is telescopically adjustable in a manner similar to other examples disclosed herein, and the tubular portions may be constructed of plastic, metal or other suitable materials.

The opposite second end 620 of the spacer portion 616 is connected to the elongated, laterally extending target portion 614. In the seventh example, the second member 616*b* is of integral construction with a main portion 614*a* of the target portion 614. The target portion 614 also is adjustable in length, which helps to accommodate user's having different widths. The main portion 614*a* slidably receives end portions 614*b*. The main portion 614*a* includes apertures 614*c* proximate each end, each of which may receive a spring push button 614*d* housed in the respective end portions 614*b*. The main portions 614*a* and end portions 614*b* may be tubular and constructed of plastic, metal or other suitable materials. It also will be appreciated that width adjustable configurations of a target portion may be employed with other examples disclosed herein.

Thus, with the seventh example, a variety of adjustable length and width positions may be chosen when the exercise training device 610 is configured as shown in FIGS. 9A-9C for connection to a laterally extending overhead bar that will be parallel to the elongated, laterally extending target portion 614, and for rotation by pivoting to a use position below and forward of the bar or to a stowed position above and rearward of the bar. When the clamp 624 is opened, initial rotation of the exercise training device 610 relative to an overhead bar permits the device to be mounted at a suitable angular orientation to be pivoted from a position of use to a position to be stowed. The clamp 624 may be closed to grip the bar and maintain a desired position. The slidable collar 626 is used to adjust the angular position of the device after connecting the clamp 624 to the bar, while the length adjustment of the spacer portion 616 permits further adjustment to accommodate users of different sizes. As such, the target portion 614 may swing through an arc from below and forward of the bar through potential positions for use, and then be pivoted to a position above and rearward of the bar to be stowed. The adjustable length of the spacer portion 616 and angle adjusting collar 626 permit a greater variety of use and stowed positions along multiple potential arcs, closer to or farther away from the overhead bar.

The spring push button 616*c* also permits an at least first member 616*a* of the spacer portion 616 to be separated from and rotatable relative to the at least one straight member 616*b* of the spacer portion 616. The first member 616*a* can be disassembled from the second member 616*b* and elongated, laterally extending target portion 614, or rotated 90 degrees for more compact shipping or stowage when the exercise training device is not connected to an overhead bar.

Figure 10C:
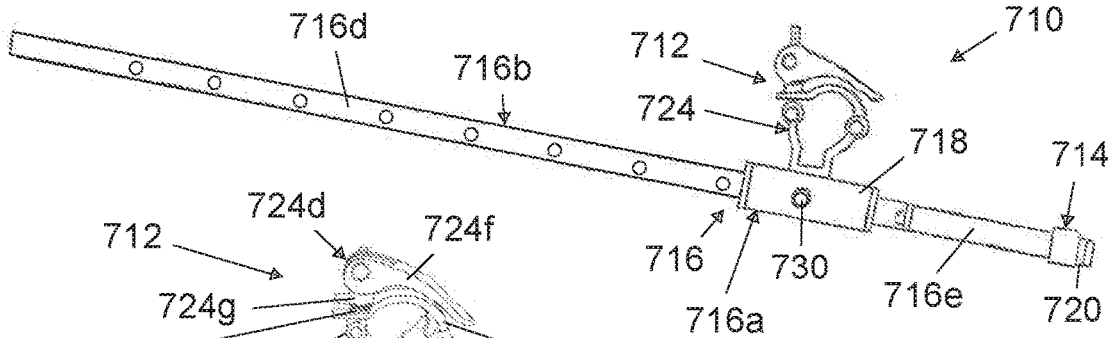
FIG. 10C is a side view of the eighth example exercise device in a fully retracted position and with the clamp of the bar mounting assembly fully closed.
Figure 10D:
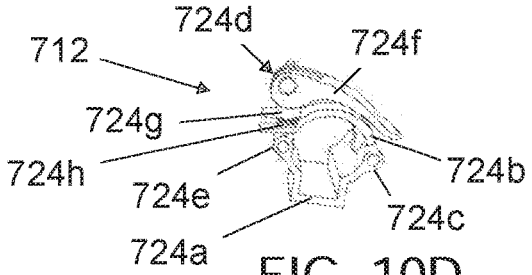
FIG. 10D is an enlarged perspective view of the clamp used in the eighth example exercise training device of FIGS. 10A-10C.
Figure 10A:
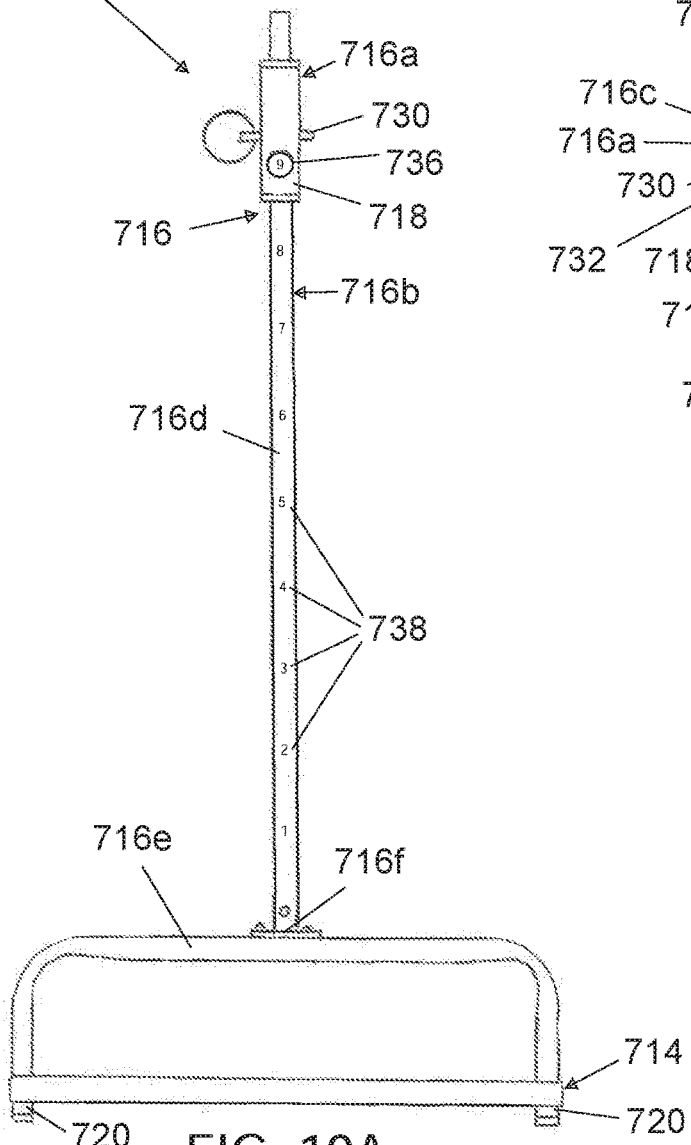
FIG. 10A is a rear view of an eighth example exercise training device.
Figure 10B:
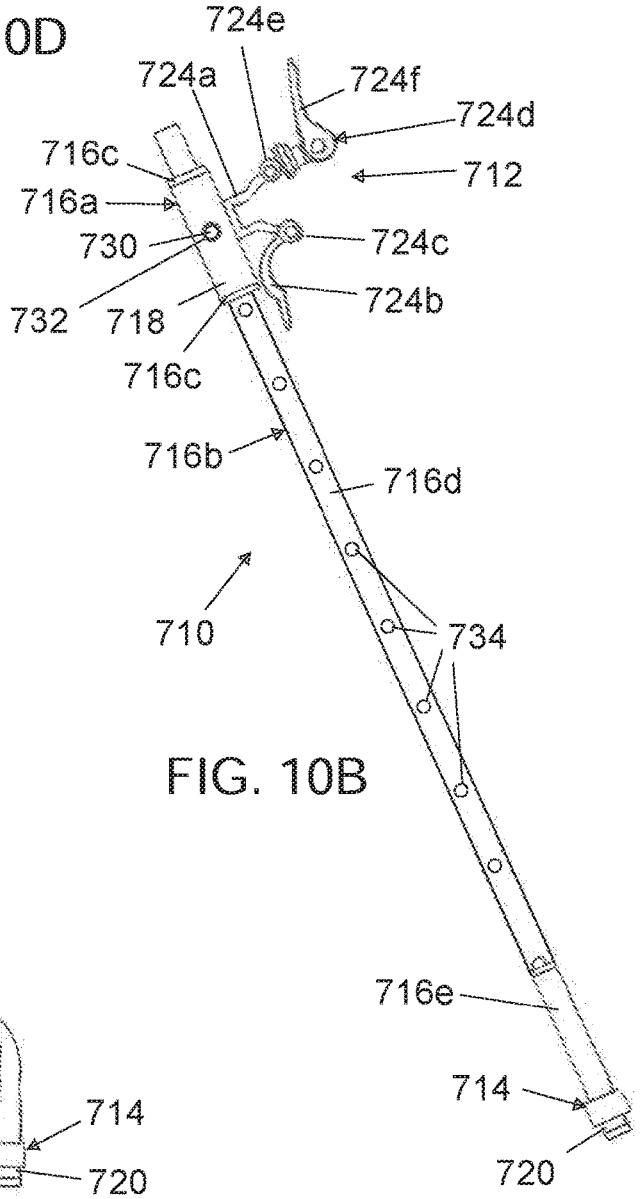
FIG. 10B is a side view of the eighth example exercise device in a fully extended position and with the clamp of the bar mounting assembly fully opened.

An eighth example exercise training device 710 may be seen in a rear view in FIG. 10A, in two side views in FIGS. 10B and 10C, and with an enlarged view of the at least one bar mounting assembly in FIG. 10D. The exercise training device 710 includes at least one bar mounting assembly 712, an elongated, laterally extending target portion 714, at least one spacer portion 716 connected at a first end 718 to and extending longitudinally away from the at least one bar mounting assembly 712, and connected at an opposed second end 720 to the elongated, laterally extending target portion 714. The device 710 forms an assembly generally having a Y-shape.

The at least one bar mounting assembly 712 of this eighth example includes a single clamp 724 that is intended to be connected to an overhead bar, such as the bar 2. The clamp 724 includes a base 724*a*, a flange 724*b* pivotally connected to the base 724*a* at a first end 724*c* of the base, and handle 724*d* pivotally connected to the base at a second end 724*e*. The handle 724*d* includes a lever 724*f* having a cam portion that is threadably connected to a pivotal member 724*g* that provides the pivotal connection to the second end 724*e* of the base 724*a*. The flange 724*b* and pivot member 724*g* may be pivoted to a fully open position to accept a bar, such as overhead bar 2, as seen in FIG. 10B. The clamp 724 then may be closed and the handle 724*d* adjusted to apply a desired gripping force to connect the device 710 to the bar 2 by threadably rotating the lever 724*f* of the handle 724*d* to a position where the lever 724*f* then may be pivoted to a closed position to have the handle 724*d* apply a final gripping force by use of the cam configuration of the lever 724*f*. The clamp 724 also may include a biasing member 724*h*, such as a compression spring, to assist in keeping the assembly in a ready position when the lever 724*f* has been moved to a position wherein the additional gripping force applied by the cam configuration of the lever 724*f* has been relieved for repositioning of the mounting assembly 712. When rotated sufficiently in the opposite direction, the lever 724*f* may permit the handle 724*d* and flange 724*b* to be pivoted in opposed directions to an open position for the device 710 to be entirely removed from the bar 2.

In the example device 710, the spacer portion 716 is telescopic and adjustable in length. The spacer portion 716 includes a tubular straight first member 716*a*, which slidably receives a tubular straight second member 716*b*. The tubular shapes utilized in this example are square, but could be of a different shape. The first member 716*a* provides a first end 718 of the spacer portion 716, which is connected to the clamp 724 of the at least one bar mounting assembly 712, such as be welding, adhesive, a fastener or the like. The first member 716*a* includes glides 716*c* at each end for smooth slidable engagement with the second member 716*b* of the spacer portion 716. The second member 716*b* includes a straight portion 716*d* connected to a U-shaped portion 716*e*, such as by a T-shaped fitting 716*f* that may be inserted into the straight portion 716*d* and connected to the outside of the U-shaped portion 716*e*, with the connections being secured by fasteners, adhesive or the like, or the straight portion 716*d* and U-shaped portion 716*e* may be integrally formed. Therefore, the opposed second end 720 of the spacer portion 716 in this example includes two ends of the U-shaped portion 716*e*, both of which are labeled 720, for convenience, and are connected to the target portion 714. The laterally extending target portion 714 is provided by a resilient band, in the form of a continuous loop similar to the sixth example, such that it is connected to the U-shaped portion 716*e* of the spacer portion 716 by being stretched and applied over the ends 720. However, it will be appreciated that the laterally extending target portion 714 may be constructed of suitable materials that are rigid, flexible and/or resilient, as desired.

As seen, when fully extended in FIGS. 10A and 10B, the spacer portion 716 is connected at a first end 718 to the bar mounting assembly 712, while being connected at an opposed second end 720 to the target portion 714. It will be appreciated that the first member 716*a* and second member 716*b* of the spacer portion 716 may be constructed of metal, plastic, or other suitable materials, and in any combination thereof. Alternatively, first member 716*a* may be integrally formed with the clamp 724, such as by molding of plastic, cast metal or the like, which would result in the second member 716*b* of the spacer portion sliding through a first member that is a portion integrally constructed with the clamp 724.

In this example, the spacer portion 716 may be adjusted to have the laterally extending target portion 714 be closer to (as seen in FIG. 10C) or further away from (as seen in FIGS. 10A and 10B) the bar to which the at least one bar mounting assembly 712 is connected. As the second end 720 of the second member 716*b* is moved relatively closer to or further away from the bar 2, the clamp 724 of the bar mounting assembly 712 may be angularly adjusted, so as to properly position the target portion 714 relative to the bar. A push pin 730 may be inserted through an aperture 732 in the first member 716*a* and any one of a plurality of apertures 734 in the second member 716*b* to select and maintain an adjusted length of the spacer portion 716. As seen in FIG. 10A, an aperture 736 through the first member 716*a* may be used to display indicia 738 on the second member to help track progress of the user. If desired, a similar aperture and indicia may be provided on the opposed sides of the first and second member, for convenience. The bar mounting assembly 712 may further include indicia along the side of the clamp 724 adjacent to where the clamp 724 grips the bar, as was shown with prior examples herein. The indicia may be in any form, as noted with other examples, so as to help track previous positions and progress.

To move the eighth example exercise training device 710 to a stowed position, the lever 724*f* of the handle 724*d* of the clamp 724 may be pivoted to relieve the force applied by the cam configuration of the lever 724*f*, so as to loosen the clamp 724 of the at least on bar mounting assembly 712 to a point that permits the device 710 to be angularly repositioned on the bar, such as to be moved to a raised, stowed position. The lever 724*f* of the handle 724*d* may be threadably rotated to open the clamp 724 and fully remove the device 710 from the bar. FIG. 10B shows the device 710 in a fully extended position but with the clamp 724 fully opened. FIG. 10C shows the spacer portion 716 fully retracted and the bar mounting assembly 712 rotated to a position for use with the target portion 714 located just forward of the connection to the overhead bar, and with the clamp 724 in a fully closed position. It will be appreciated that by loosening and then rotating the bar mounting assembly 712 relative to the overhead bar, the device 710 may be adjusted or moved to a stowed position, or the clamp 724 may be opened and the device 710 may be removed from the bar.

A ninth example exercise training device 810 is shown in a front view in FIG. 11A, in a side view of an extended position for use in FIG. 11B and in a further side view of a retracted stowed position in FIG. 11C. The exercise training device 810 includes at least one bar mounting assembly 812, an elongated, laterally extending target portion 814, at least one spacer portion 816 connected at a first end 818 to and extending longitudinally away from the at least one bar mounting assembly 812, and connected at an opposed second end 820 to the elongated, laterally extending target portion 814. The device 810 forms an assembly generally having a T-shape.

The at least one mounting assembly 812 of this ninth example includes a single clamp 824 that is intended to be connected to an overhead bar, such as bar 2. The clamp 824 is similar to the clamp 424 of the fifth example, has a pair of pivotally connected jaws 824*a*, and a rotatable fastener 824*b* that can be rotated by a handle 824*c* at one end, so as to open or close the jaws 824*a* and to adjust the gripping force of the clamp 824. Thus, the clamp 824 may be opened to receive an overhead bar, such as the overhead bar 2, and then the handle 824*c* may be rotated to move the clamp jaws 824*a* toward a closed position, so as to grip and maintain an adjusted angular position relative to the overhead bar. It also will be appreciated that each clamp of this example or others disclosed herein could be of the type that has a cam lever, so as to simply pivot the lever to adjust the clamp from being released for angular adjustment relative to the bar, to a position where the clamp is tightened to apply a gripping force to hold the clamp in place. Any of the other example bar mounting assemblies shown herein, or further alternative bar mounting assemblies may be used to permit adjustment and positioning of the device for use and for stowage, whether on the bar or removed therefrom.

The bar mounting assembly 812 also includes indicia 822 along the side of the clamp 824 adjacent to where the clamp 824 grips the bar. Such indicia may include a scale, lettering or enumeration as desired to assist in tracking the angular position, such as relative to a bottom center point on the bar, which is useful in training to readily return to a previously utilized position and to track progress.

With the ninth example exercise training device 810, the elongated, laterally extending target portion 814 and spacer portion 816 may be constructed of rigid tubing, such as plastic, metal, or the like, or of solid materials such as plastic, metal, wood or the like. The spacer portion 816 includes a first member 816*a*, which is pivotally connected to a second member 816*b* via a locking pivot assembly 816*c*. A first end 818 of the spacer portion 816 may be connected to the bar mounting assembly 812, such as by use of a fastener, press fit over a post, adhesive or the like. A second end 820 of the spacer portion 816 may be connected to the elongated, laterally extending target portion in a similar manner, or such as by welding or may be integrally formed therewith.

The locking pivot assembly 816*c* includes a pair of jaw fittings 816*d* that are respectively connected to the first member 816*a* and the second member 816*b* at the end opposed to respective ends 818, 820. The locking pivot assembly 816*c* includes a fastener 816*e* that extends through the jaw fittings 816*d*, which provides a pivot axis and further includes a handle 816*f* which may be configured as a cam locking handle that may be rotated to increase tension and then pivoted to a position toward a face of one of the jaw fittings to lock the locking pivot assembly 816*c* in a selected angular position.

The locking pivot assembly 816*c* may have indicia 816*g* on one or both outer faces of the jaw fittings 816*d* to help track and return to selected positioning of the target portion 814 relative to the overhead bar to which the exercise training device 810 is connected. Pivoting of the bar mounting assembly 812 and the locking pivot assembly 816*c* permit a user to position the target portion in a range of positions for use as well as to be stowed. For example, FIGS. 11A and 11B show the device 810 in a position that would be extending downward and forward relative to an overhead bar. It will be appreciated that the target may be articulated to an expansive range of positions for use, while FIG. 11C shows one of a range of stowed positions, wherein the target portion 814 may be located above the overhead bar.

Figure 12C:
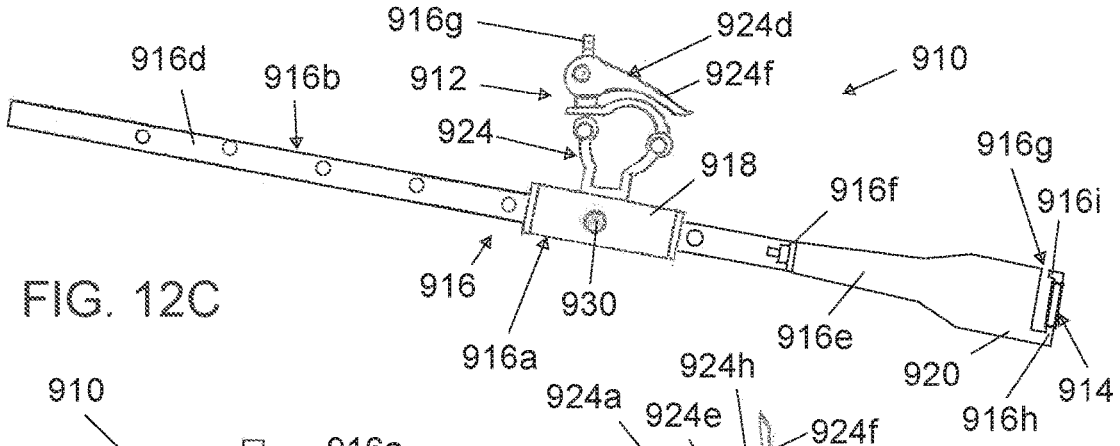
FIG. 12C is a side view of the eighth example exercise device in a partially retracted position and with the clamp of the bar mounting assembly fully closed.
Figure 12A:
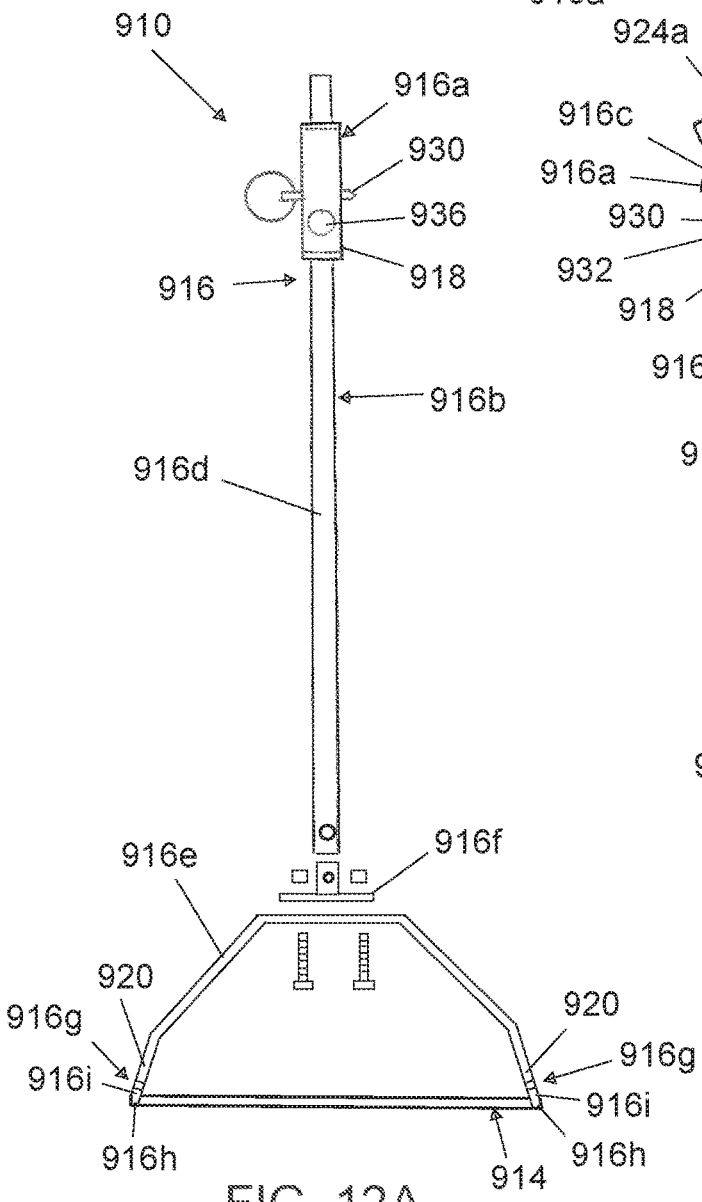
FIG. 12A is a rear partially exploded view of a tenth example exercise training device.
Figure 12B:
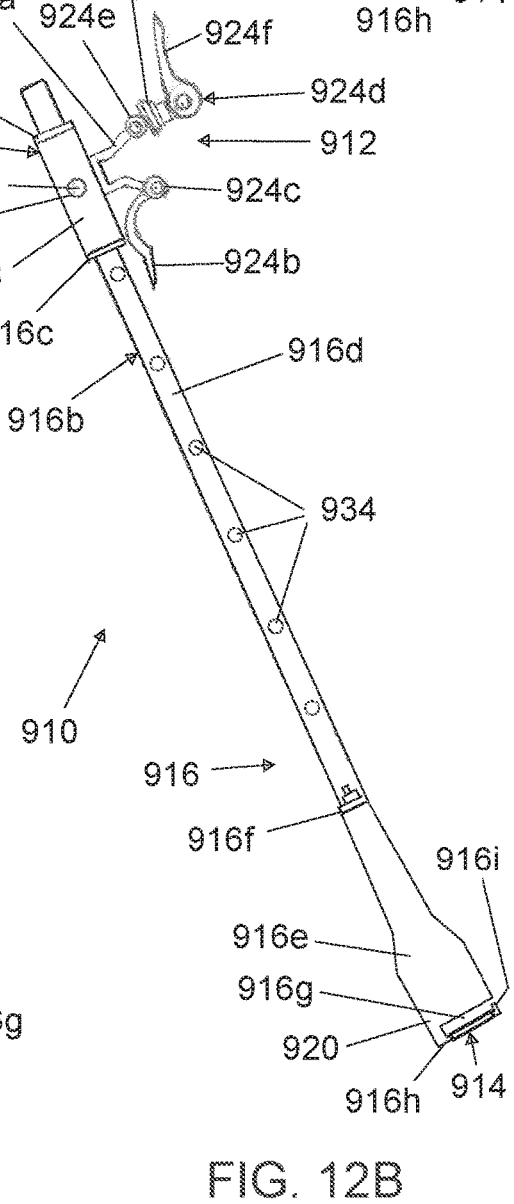
FIG. 12B is a side view of the eighth example exercise device in a fully extended position and with the clamp of the bar mounting assembly fully open.

A tenth example exercise training device 910 may be seen in a partially exploded rear view in FIG. 12A, and in two side views in FIGS. 12B and 12CD. The exercise training device 910 includes at least one bar mounting assembly 912, an elongated, laterally extending target portion 914, at least one spacer portion 916 connected at a first end 918 to and extending longitudinally away from the at least one bar mounting assembly 912, and removably connected at an opposed second end 920 to the elongated, laterally extending target portion 914. The device 910 forms an assembly that is generally Y-shaped.

The at least one bar mounting assembly 912 of this tenth example includes a clamp, shown as a single clamp 924 that is intended to be connected to an overhead bar, such as the bar 2. The clamp could be a spring claim but in this example the clamp 924 is identical to the clamp 724 of the eighth example. As such, the clamp 924 includes a base 924*a*, a flange 924*b* pivotally connected to the base 924*a* at a first end 924*c* of the base, and a handle 924*d* pivotally connected to the base at a second end 924*e*. The handle 924*d* includes a lever 924*f* having a cam portion that is threadably connected to a pivotal member 924*g* that provides the pivotal connection to the second end 924*e* of the base 924*a*. The flange 924*b* and pivot member 924*g* may be pivoted to a fully open position to accept a bar, such as overhead bar 2, as seen in FIG. 12B. The clamp 924 then may be closed and the handle 924*d* adjusted to apply a desired adjustable gripping force to connect the device 910 to the bar 2 by threadably rotating the lever 924*f* of the handle 924*d* to a position where the lever 924*f* then may be pivoted to a closed position to have the handle 924*d* apply a final gripping force by use of the cam configuration of the lever 924*f*, which is shown in FIG. 12C but without the bar for ease of viewing the device 910. The device 910 may be placed at any desire angle on the bar prior to applying the clamping force to hold the device in a selected position on the bar. The clamp 924 also may include a biasing member 924*h*, such as a compression spring, to assist in keeping the assembly in a ready position when the lever 924*f* has been moved to a position wherein the additional gripping force applied by the cam configuration of the lever 924*f* has been relieved for repositioning of the mounting assembly 912. When rotated sufficiently in the opposite direction, the lever 924*f* may permit the handle 924*d* and flange 924*b* to be pivoted in opposed directions to an open position for the device 910 to be entirely removed from the bar 2, such as shown in FIG. 12B.

In the example device 910, the spacer portion 916 is telescopic and adjustable in length. The spacer portion 916 includes a tubular straight first member 916*a*, which slidably receives a tubular straight second member 916*b*. The tubular shapes utilized in this example are square, but could be of a different shape. The first member 916*a* provides a first end 918 of the spacer portion 916, which is connected to the clamp 924 of the at least one bar mounting assembly 912, such as be welding, adhesive, a fastener or the like. The first member 916*a* includes glides 916*c* at each end for smooth slidable engagement with the second member 916*b* of the spacer portion 916. The second member 916*b* includes a straight portion 916*d* connected to a generally U-shaped portion 916*e*, such as by a T-shaped fitting 916*f* that may be inserted into the straight portion 916*d* and connected by a fastener, such as a screw (not shown). The T-shaped fitting 916*f* may be connected to the base of the U-shaped portion 916*e*, with the connections being secured by fasteners, such as nuts and bolts, adhesive or the like. As with some of the previous examples, the assembly of the straight portion 916*d* and U-shaped portion 916*e* extend generally in a single plane, and alternatively may be integrally formed. Therefore, the opposed second end 920 of the spacer portion 916 in this example includes two ends of the U-shaped portion 916*e*, both of which are labeled 920, and which are conveniently removably connected to the target portion 914. As noted with previously describe examples, the laterally extending target portion may be constructed of resilient, flexible or flexible and resilient material. In the tenth example, the target portion 914 is provided by a resilient band, in the form of a continuous loop similar to the sixth and eighth examples, such that it is removably connected to the U-shaped portion 916*e* of the spacer portion 916 by being stretched and applied over the ends 920.

It will be appreciated that the target portion is removably connected to the spacer portion in some of the previous examples, such as with the second, sixth and eighth examples. The tenth example device 910 differs from the eighth example with respect to the U-shaped portion 916*e*, which is formed of bent flat stock metal, such as aluminum or steel, and which includes slots 916*g* that provide legs 916*h*. Each leg 916*h* has a stop portion 916*i* at the open end of the slot 916*g*. The tenth example differs from the eighth also with respect to the configuration permitting the target portion 914 to be stretched and slipped over and retained by the legs 916*h* and stops 916*i*. The stops 916*i* assist in retaining the target portion 914 on the spacer portion. The resilient band of the target portion 914 is held in a manner that exposes the width of the band at an angle that is perpendicular to the generally planar structure of the device 910. This is an angle that is rotated 90 degrees relative to the orientation of the resilient band of the target portion 714 in the eighth example device 710, which extended generally in the same plane as the generally planar structure of the device 710. This configuration of the tenth example device 910 provides for easy and convenient assembly and/or replacement of the target portion 914, while also being less susceptible to being disrupted or dislodged from the assembled position on the U-shaped portion 916*e* when contacted by the feet or ankles of an individual using the device 910. However, it will be appreciated that the laterally extending target portion 914 alternatively may be constructed of suitable materials that are rigid, flexible and/or resilient, as desired. It also will be appreciated that the width and length of the device 910 may be selected as desired to accommodate users of various sizes.

As seen, when fully extended in FIGS. 12A and 12B, the spacer portion 916 is connected at a first end 918 to the bar mounting assembly 912, while being connected at an opposed second end 920 to the target portion 914. It will be appreciated that the first member 916*a* and second member 916*b* of the spacer portion 916 may be constructed of metal, plastic, or other suitable materials, and in any combination thereof. Alternatively, first member 716*a* may be integrally formed with the clamp 924, such as by molding of plastic, cast metal or the like, which would result in the second member 916*b* of the spacer portion sliding through a first member that is a portion integrally constructed with the clamp 924.

In this example, the spacer portion 916 may be adjusted to have the laterally extending target portion 914 be closer to (as seen in FIG. 12C) or further away from (as seen in FIGS. 12A and 12B) the bar to which the at least one bar mounting assembly 912 is connected. As the second end 920 of the second member 916*b* is moved relatively closer to or further away from the bar 2, the clamp 924 of the bar mounting assembly 912 may be angularly adjusted, so as to properly position the target portion 914 relative to the bar. A push pin 930 may be inserted through an aperture 932 in the first member 916*a* and any one of a plurality of apertures 934 in the second member 916*b* to select and maintain an adjusted length of the spacer portion 916. As was shown with respect to the eighth example, there may be an aperture or other means associated with the first member 916*a* and/or second member 916*b* using an aperture and/or display indicia to help track the extended length of the device 912 and corresponding progress of the user. An aperture and indicia configuration may be provided on any of the sides of the components of the spacer 916. The bar mounting assembly 912 may further include indicia along the side of the clamp 924 adjacent to where the clamp 924 grips the bar, as was shown with prior examples herein. The indicia may be in any form, as noted with other examples, so as to help track previous positions and progress.

To move the tenth example exercise training device 910 to a stowed position, the lever 924*f* of the handle 924*d* of the clamp 924 may be pivoted to relieve the force applied by the cam configuration of the lever 924*f*, so as to loosen the clamp 924 of the at least on bar mounting assembly 912 to a point that permits the device 910 to be angularly repositioned on the bar, such as to be moved to a raised, stowed position. The lever 924*f* of the handle 924*d* also may be threadably rotated to open the clamp 924 and fully remove the device 910 from the bar. FIG. 12B shows the device 910 in a fully extended position but with the clamp 924 fully opened. FIG. 12C shows the spacer portion 916 nearly fully retracted and the bar mounting assembly 912 rotated to a position for use with the target portion 914 located just forward of where the 924 of the bar mounting assembly 912 would be connected to the overhead bar, and with the clamp 924 in a fully closed position. It will be appreciated that by loosening and then rotating the bar mounting assembly 912 relative to the overhead bar (not shown), the device 910 may be adjusted or moved to a stowed position, or the clamp 924 may be opened and the device 910 may be removed from the bar.

It will be understood that the examples described above are illustrative of some of the applications of the principles of the present subject matter. Thus, while examples were provided and discussed with respect to exercise training devices, it is contemplated that the devices may be constructed in many different ways while providing many of the above-mentioned advantages. Further additions or alterations may be made to the example devices disclosed herein or to methods of using such devices, and may be made without departing from the spirit and scope of the present disclosure. Numerous modifications may be made by those skilled in the art without departing from the spirit and scope of the claimed subject matter, including but not limited to combinations of features that are individually disclosed in different examples or claimed herein. For these reasons, the scope of this disclosure is not limited to the above examples but is as set forth in the appended claims.

What is claimed is:

1. An exercise training device configured for connection to a laterally extending overhead bar and for use in modifying a toes to bar exercise, comprising:

at least one bar mounting assembly comprising a clamp configured to receive or be removed from the overhead bar when the clamp is open and to grip the overhead bar in angular positions relative to the overhead bar when the clamp is closed;

a spacer portion that is adjustable in length and connected at a first end to and extending longitudinally away from the at least one bar mounting assembly, and connected at an opposed second end to an elongated, laterally extending target portion;

wherein the at least one bar mounting assembly and the spacer portion are configured to support the elongated, laterally extending target portion for use in a position below the overhead bar and the elongated, laterally extending target portion is configured to provide a target to be contacted by feet of a user when the user grasps and hangs from the overhead bar while training to perform a modified toes to bar exercise.

2. The exercise training device of claim 1, wherein the clamp and spacer portion are configured to position the elongated, laterally extending target portion above the overhead bar in a stowed position when not being used to perform a modified toes to bar exercise.

3. The exercise training device of claim 1, wherein the clamp further comprises a spring clamp.

4. The exercise training device of claim 1, wherein the clamp has adjustable gripping force.

5. The exercise training device of claim 1, wherein the clamp comprises a lever having a cam configuration.

6. The exercise training device of claim 1, wherein the elongated, laterally extending target portion is constructed of substantially rigid material.

7. The exercise training device of claim 1, wherein the spacer portion includes at least a first member connected to the at least one bar mounting assembly and at least a second member connected to the elongated, laterally extending target portion.

8. The exercise training device of claim 7, wherein the at least first member and at least second member each have at least one through aperture and are connected by a pin located in the respective at least one apertures.

9. An exercise training device configured for connection to a laterally extending overhead bar and for use in modifying a toes to bar exercise, comprising:

at least one bar mounting assembly comprising a clamp configured to receive or be removed from the overhead bar when the clamp is open and to grip the overhead bar in angular positions relative to the overhead bar when the clamp is closed;

a spacer portion that is adjustable in length and connected at a first end to and extending longitudinally away from the at least one bar mounting assembly, and connected at an opposed second end to an elongated, laterally extending target portion;

wherein the elongated, laterally extending target portion is constructed of a flexible material;

wherein the at least one bar mounting assembly and the spacer portion are configured to support the elongated, laterally extending target portion for use in a position below the overhead bar and the elongated, laterally extending target portion is configured to provide a target to be contacted by feet of a user when the user grasps and hangs from the overhead bar while training to perform a modified toes to bar exercise.

10. The exercise training device of claim 9, wherein the flexible material of the elongated, laterally extending target portion is resilient.

11. The exercise training device of claim 10, wherein the elongated, laterally extending target portion is configured as a band.

12. The exercise training device of claim 11, wherein the band of the elongated, laterally extending target portion is configured as a loop which extends over legs at the opposed second end of the spacer portion.

13. The exercise training device of claim 1, wherein the elongated, laterally extending target portion is a loop which extends over legs at the opposed second end of the spacer portion.

14. The exercise training device of claim 13, wherein the legs have stop portions that assist in retaining the target portion on the spacer portion.

15. The exercise training device of claim 1, wherein the spacer portion extends generally in a single plane.

16. The exercise training device of claim 1, wherein the spacer portion extends generally in a single plane and the elongated, laterally extending target portion extends in a plane generally perpendicular to the general plane of the spacer portion.

17. An exercise training device configured for connection to a laterally extending overhead bar and for use in modifying a toes to bar exercise, comprising:

at least one bar mounting assembly comprising a clamp configured to receive or be removed from the overhead bar when the clamp is open and to grip the overhead bar in angular positions relative to the overhead bar when the clamp is closed;

a spacer portion that is generally Y-shaped and is adjustable in length and connected at a first end to and extending longitudinally away from the at least one bar mounting assembly, and connected at an opposed second end to an elongated, laterally extending target portion;

wherein the at least one bar mounting assembly and the spacer portion are configured to support the elongated, laterally extending target portion for use in a position below the overhead bar and the elongated, laterally extending target portion is configured to provide a target to be contacted by feet of a user when the user grasps and hangs from the overhead bar while training to perform a modified toes to bar exercise.

18. The exercise training device of claim 17, wherein the spacer portion includes a U-shaped portion connected to a straight portion.

19. The exercise training device of claim 18, wherein a T-shaped connector connects the U-shaped portion to the straight portion.

* * * * *